US010906301B2

(12) United States Patent
Teraji

(10) Patent No.: US 10,906,301 B2
(45) Date of Patent: Feb. 2, 2021

(54) INKJET PRINTING APPARATUS

(71) Applicant: CANON KABUSHIKI KAISHA, Tokyo (JP)

(72) Inventor: Tomoya Teraji, Hino (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/502,915

(22) Filed: Jul. 3, 2019

(65) Prior Publication Data

US 2020/0023636 A1 Jan. 23, 2020

(30) Foreign Application Priority Data

Jul. 20, 2018 (JP) ..... 2018-136687

(51) Int. Cl.
*B41J 2/045* (2006.01)

(52) U.S. Cl.
CPC ..... *B41J 2/0458* (2013.01); *B41J 2/0451* (2013.01); *B41J 2/0457* (2013.01); *B41J 2/04541* (2013.01); *B41J 2/04548* (2013.01); *B41J 2202/20* (2013.01)

(58) Field of Classification Search
CPC .. B41J 2/0458; B41J 2/04541; B41J 2/04548; B41J 2/0451; B41J 2/0457; B41J 2202/20
See application file for complete search history.

(56) References Cited

U.S. PATENT DOCUMENTS

| | | | | |
|---|---|---|---|---|
| 8,899,707 | B2 | 12/2014 | Teraji | |
| 9,296,231 | B2 | 3/2016 | Teraji | |
| 9,643,413 | B2 | 5/2017 | Teraji | |
| 10,406,837 | B2 | 9/2019 | Teraji | |
| 10,647,113 | B2 * | 5/2020 | Ueki | B41J 2/04543 |

FOREIGN PATENT DOCUMENTS

JP 2007-281575 A 10/2007

* cited by examiner

*Primary Examiner* — Geoffrey S Mruk
(74) *Attorney, Agent, or Firm* — Venable LLP

(57) ABSTRACT

A second power is lower than a first power to be supplied during a printing operation. In a case where the second power is supplied to a print head through a cable as a drive power for the nozzles in the print head, the change in voltage of the second power is detected. The nozzles in the nozzle arrays are driven on an array-by-array basis with the second power on the basis of a control signal, and whether there is breakage in the cable is detected on the basis of the result of the detection of the change in voltage of the second power during the driving of the nozzles.

23 Claims, 16 Drawing Sheets

| FIRST NOZZLE ARRAY | SECOND NOZZLE ARRAY | ALL OTHER NOZZLE ARRAYS | IDENTIFIED BROKEN SIGNAL LINE |
|---|---|---|---|
| NG | OK | OK | SIGNAL LINE FOR SERIAL DATA (SDATA1) |
| OK | NG | OK | SIGNAL LINE FOR SERIAL DATA (SDATA2) |
| NG | NG | OK | SIGNAL LINE FOR HEAT SIGNAL (HT1) |
| NG | NG | NG | SIGNAL LINES FOR CLOCK SIGNAL (CLK) AND LATCH SIGNAL (LT) |

FIG.9

INKJET PRINTING APPARATUS

BACKGROUND OF THE INVENTION

Field of the Invention

The present invention relates to an inkjet printing apparatus having a function of detecting breakage in a cable connected to a print head.

Description of the Related Art

A so-called serial scan-type printing apparatus as an inkjet printing apparatus prints an image onto a print medium by ejecting ink from a print head while moving a carriage on which the print head is mounted. The print head, mounted on the carriage, is connected to a control unit provided at a predetermined position on the apparatus body side through a circuit board fixed to the carriage and a flexible flat cable (hereinafter also referred to as "FFC"). Through this FFC, drive power, control signals, and so on are supplied from the control unit to the print head. Since the FFC is repeatedly deformed with movement of the carriage, any of its wirings may possibly be broken after a long-term use.

Japanese Patent Laid-Open No. 2007-281575 discloses a technique for detecting breakage of an FFC repeatedly deformed as mentioned above. Specifically, a special wiring for detecting breakage is provided in at least one of the two side edges of the FFC. A voltage is applied to a closed circuit formed by the breakage detection wiring, and whether the FFC is broken is detected on the basis of the change in that voltage.

SUMMARY OF THE INVENTION

However, in Japanese Patent Laid-Open No. 2007-281575, the special wiring for detecting breakage must be provided in the FFC. Moreover, what can be detected is only breakage of the breakage detection wiring in the FFC. Thus, it is impossible to detect breakage of each of the other wirings in the FFC (such as the wirings for drive power and control signals). Also, in a case where broken portions of any of these other wirings are connected or disconnected depending on the state of the FFC, this breakage cannot be detected.

The present invention provides an inkjet printing apparatus capable of detecting breakage of each of a plurality of wirings in a cable.

In the first aspect of the present invention, there is provided an inkjet printing apparatus comprising:

a print head comprising a plurality of nozzle arrays each being an array of a plurality of nozzles capable of ejecting ink;

a carriage on which the print head is mounted and which is capable of moving in a direction crossing the nozzle arrays;

a control unit configured to supply a first power as a drive power for the nozzles for ejecting the ink from the nozzles and a control signal for controlling drive of the nozzles to the print head through a cable, the control unit driving the nozzles with the first power on the basis of the control signal while moving the carriage during a printing operation; and a voltage detection unit configured to detect a change in voltage of a second power in a case where the second power is supplied to the print head through the cable as a drive power for the nozzles, the second power being a supply power lower than the first power, wherein the control unit executes a breakage detection operation involving driving the nozzles in the nozzle arrays on an array-by-array basis with the second power on the basis of the control signal, and detecting whether there is breakage in the cable on the basis of a result of the detection by the voltage detection unit during the driving of the nozzles, and the control unit executes the breakage detection operation in a state where the carriage is stopped.

In the second aspect of the present invention, there is provided an inkjet printing apparatus comprising:

a print head comprising a plurality of nozzle arrays each being an array of a plurality of nozzles capable of ejecting an ink;

a carriage on which the print head is mounted and which is capable of moving in a direction crossing the nozzle arrays;

a control unit configured to supply a first power as a drive power for the nozzles for ejecting ink from the nozzles and a control signal for controlling drive of the nozzles to the print head through a cable, the control unit driving the nozzles with the first power on the basis of the control signal while moving the carriage during a printing operation; and a voltage detection unit configured to detect a change in voltage of a second power in a case where the second power is supplied to the print head through the cable as a drive power for the nozzles, the second power being a supply power lower than the first power, wherein the control unit executes a breakage detection operation involving driving the nozzles in the nozzle arrays on an array-by-array basis with the second power on the basis of the control signal, and detecting whether there is breakage in the cable on the basis of a result of the detection by the voltage detection unit during the driving of the nozzles, and the control unit executes the breakage detection operation while moving the carriage.

According to the present invention, it is possible to detect breakage of each of a plurality of wirings in a cable with a simple configuration.

Further features of the present invention will become apparent from the following description of exemplary embodiments with reference to the attached drawings.

BRIEF DESCRIPTION OF THE DRAWINGS

FIG. 9 is an explanatory diagram of a process of identifying a broken signal line in FIG. 8B;

DESCRIPTION OF THE EMBODIMENTS

Embodiments of the present invention will be described below on the basis of the drawings.

First Embodiment

FIGS. 1A to 7 are diagrams for explaining a first embodiment of the present invention. The present embodiment will be described below through separate sections of (1) "Entire Configuration of Printing Apparatus", (2) "Basis Configuration of Control System", (3) Configuration of Print Head, and (4) "Configuration for Detecting Breakage".

(1) "Entire Configuration of Printing Apparatus"

Figure 1A:
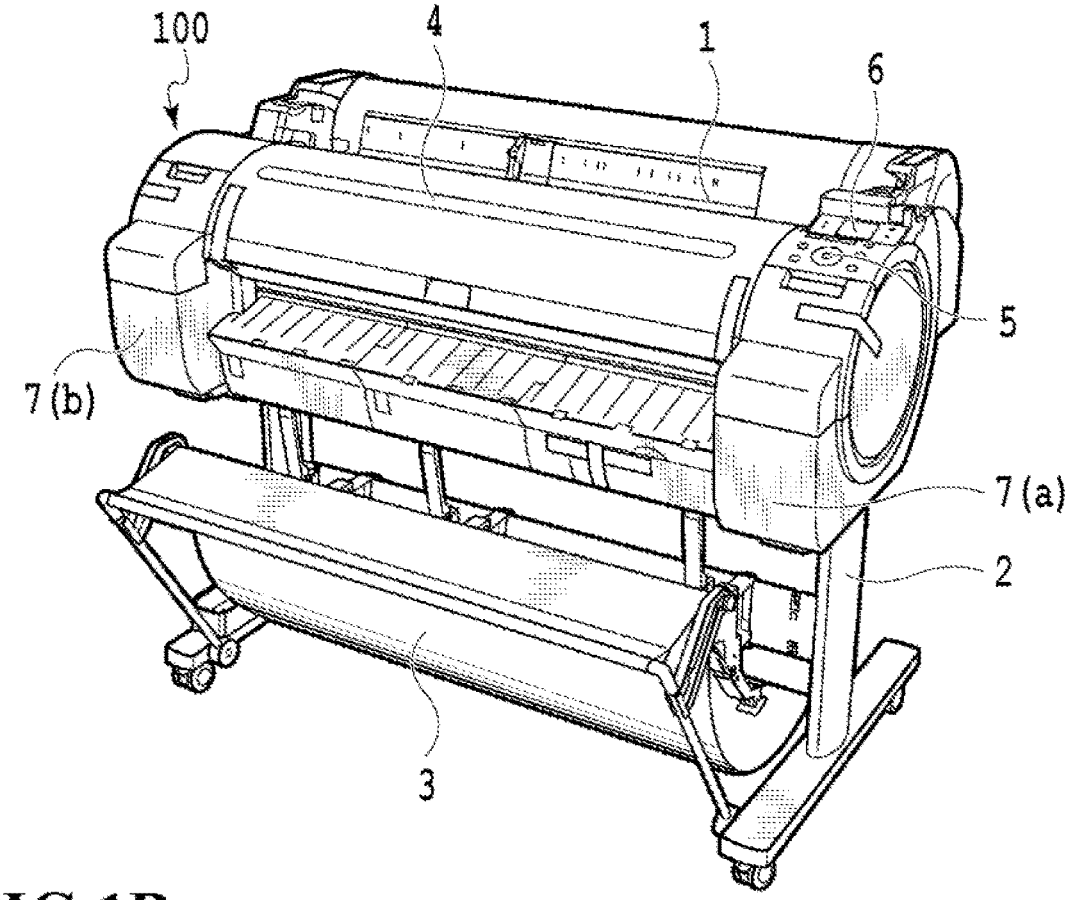
FIG. 1A is a perspective view of the body of a printing apparatus in a first embodiment of the present invention.

FIG. 1A is a perspective view for explaining the entire configuration of a printing apparatus 100 in the present embodiment. The printing apparatus 100 in the present example is a serial scan-type inkjet printing apparatus that prints an image onto a print medium of the A0 size or the B0 size. The print medium, such as print paper, can be set at the top of the printing apparatus 100. The print medium may be a cut sheet of a predetermined length or a long roll sheet, and is supplied automatically or manually into the printing apparatus 100 from an insertion port 1. The body of the printing apparatus 100 (hereinafter also referred to as "apparatus body") is supported on a printer stand 2 formed of two leg parts. The apparatus body comprises a sheet discharge tray 3 which houses a print medium discharged after an image is printed thereon, and an upper cover 4 which is openable and closable and through which the inside is visible. Also, an operation panel unit 5 and a display panel unit 6 that provides information to the user are installed on the right side of the apparatus body in FIG. 1A. Also, ink supply units and ink tanks 7(*a*) and 7(*b*) are installed on both the right and left sides of the apparatus body in FIG. 1A.

Figure 1B:
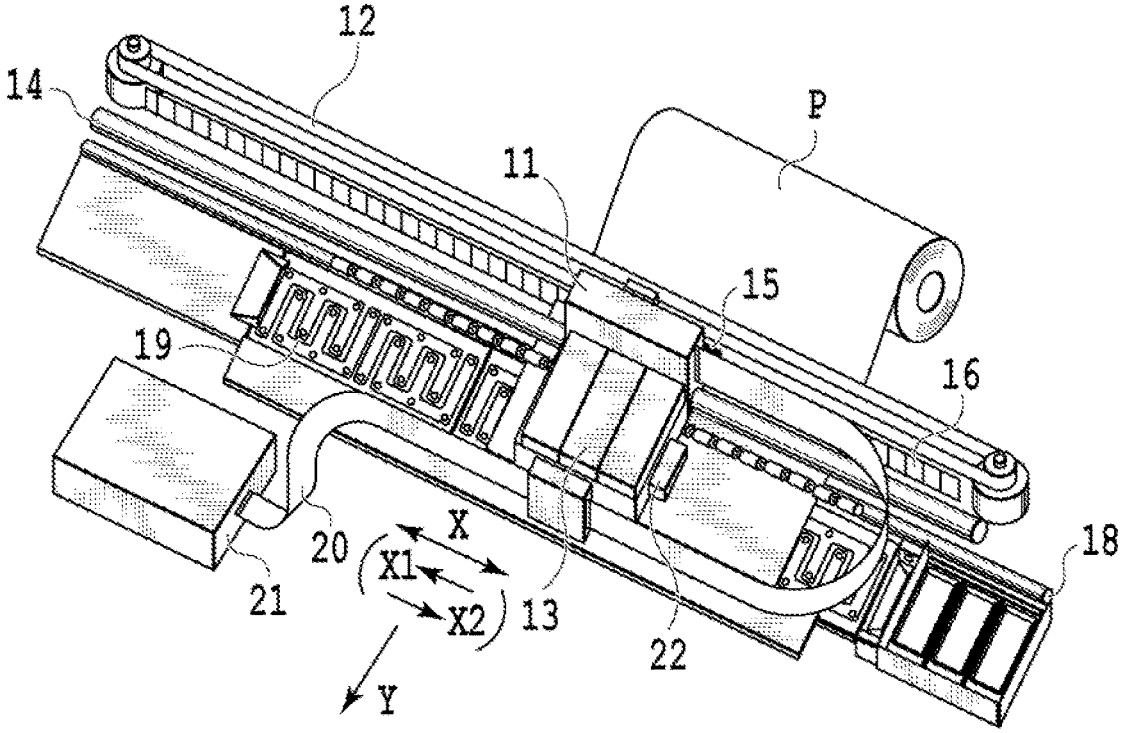
FIG. 1B is a perspective view of the inside of the printing apparatus in FIG. 1A.

FIG. 1B is a perspective view of the inside of the apparatus body with the upper cover 4 removed. The printing apparatus 100 comprises a conveyance roller 18 that conveys a print medium P in the direction of arrow Y (sub scanning direction), and a carriage unit 11 that is capable of reciprocating in the direction of arrow X (main scanning direction) crossing (perpendicularly in the present example) the sub scanning direction.

The printing apparatus 100 further comprises a carriage motor (not illustrated) and a carriage belt 12 that cause the carriage unit 11 to reciprocate in the direction of arrow X, and a print head 13 that is detachably attached to the carriage unit 11. The carriage unit 11 is movably supported on a main shaft 14 extending in the main scanning direction along arrow X. An encoder sensor 15 mounted to the carriage unit 11 detects the movement position of the carriage unit 11 by reading a linear scale 16. In the present example, one print head 13 is mounted on the carriage unit 11, and inks of five colors are supplied to that print head 13. For example, a black (PBk) ink, a mud black (MBk) ink, a yellow (Ye) ink, a magenta (Ma) ink, and a cyan (Cy) ink are supplied to the print head 13.

In printing an image onto the print medium P, firstly, the print medium P is conveyed by the conveyance roller 18 to a predetermined printing start position on a platen 19. Then, a printing scanning in which the inks are ejected from the print head 13 with the print head 13 moved in the main scanning direction by the carriage unit 11, and an operation in which the print medium P is conveyed in the sub scanning direction by the conveyance roller 18 are repeated. As a result, the image is printed onto the print medium P.

More specifically, the inks are ejected from the print head 13 with the print head 13 moved along with the carriage unit 11 by the carriage belt 12 and the carriage motor (not illustrated) in the forward direction along arrow X1 from an initial position (home position). As a result, forward direction printing is performed on the print medium P. Then, after the carriage unit 11 is moved to a return position (reverse position), the print medium P is conveyed in the sub scanning direction along arrow Y by the conveyance roller 18. Then, inks are ejected from the print head 13 with the print head 13 moved along with the carriage unit 11 in the backward direction along arrow X2 from the return position, so that backward direction printing is performed on the print medium P. By repeating forward direction printing and backward direction printing as above, an image, characters, and so on are printed onto the print medium P. After the printing of a single print medium P is finished by repeating such operations, that print medium is discharged onto the sheet discharge tray 3, and the printing operation for the single print medium is completed.

The carriage unit 11 is electrically connected to a main circuit board 21 by a flexible flat cable (hereinafter also referred to as "FFC") 20. The supply of power to the print head 13, the control of the print head 13, and the input of the detection signal of the encoder sensor 15 are performed through this FFC 20. The number of FFCs 20 is not limited to one but may be two or more. Also, an optical sensor 22 is mounted to the carriage unit 11. The optical sensor 22 is used, for example, for determination of the type of the print medium P, detection of the distance between the print head 13 and the print medium P, detection of the width of the print medium P set in the printing apparatus 100, and so on.

(2) "Basic Configuration of Control System"

Figure 2:
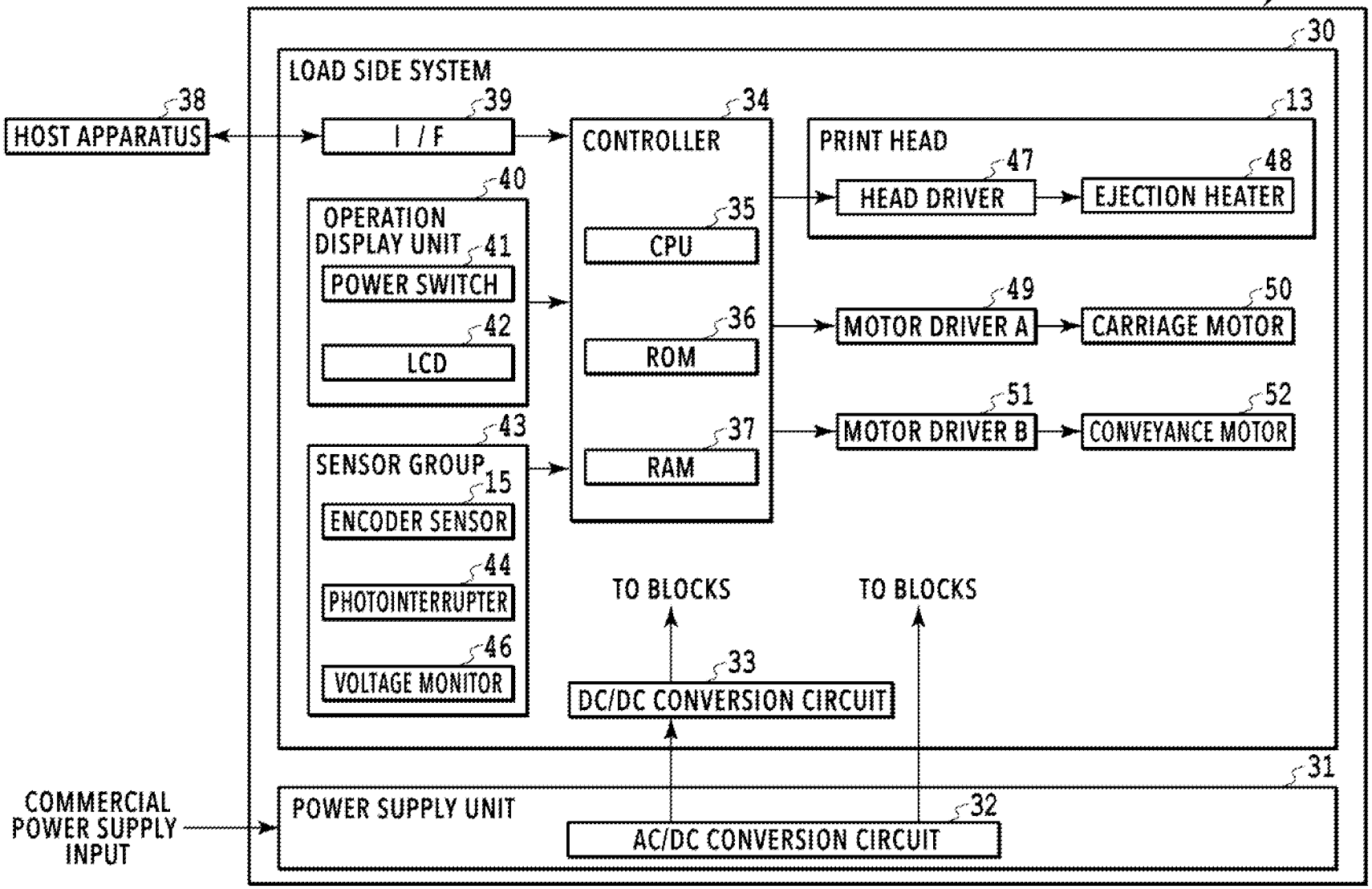
FIG. 2 is an explanatory diagram of the basic configuration of a control system in the printing apparatus in FIGS. 1A and 1B.

FIG. 2 is a block diagram for explaining the basic configuration of a control system in the printing apparatus 100. The printing apparatus 100 includes a load side system 30 and a power supply unit 31. The load side system 30 and the power supply unit 31 are electrically connected to each other by using members such as connectors and cables (not illustrated). The power supply unit 31 converts a voltage inputted from a commercial power supply into a predetermined voltage with an AC/DC conversion circuit 32 and then supplies it to the load side system 30. A DC/DC conversion circuit 33 has a function of converting the DC output voltage from the AC/DC conversion circuit 32 into a predetermined DC voltage required by each block in the load side system 30 and distributing the predetermined DC voltage to the block. For example, the DC/DC conversion circuit 33 is formed of a switching regulator and its peripheral circuits.

A controller 34 is a main control unit and comprises, for example, a CPU 35 in the form of a microcomputer, an ROM 36 storing fixed data such as programs and required tables, and an RAM 37 in which an image data deployment area, a work area, and so on are provided. A host apparatus 38 is a supply source of image data connected to the printing apparatus 100 and may be in the form of a computer that performs generation, processing, and so on of image data or in the form of a reader unit that reads images or the like. Commands, status signals, and so on as well as image data signals are transmitted and received between the host apparatus 38 and the controller 34 through an interface (I/F) 39.

An operation display unit 40 comprises a switch group that receives instruction inputs from the operator and an LCD 42 that provides internal information on the printing apparatus 100 and so on to the operator. The switch group includes a power switch 41 and so on. A sensor group 43 is a detection group that detects the state of the printing apparatus 100 and includes the encoder sensor 15 mounted to the carriage unit 11, and a photointerrupter 44 for detecting that the carriage unit 11 has moved to the home position. The sensor group 43 further includes a voltage monitor 46 that monitors a later-described ejection heater drive voltage (VH) to be supplied to the print head 13, and so on. A head driver 47 drives later-described ejection heaters 48 in the print head 13 in accordance with print data or the like. A motor driver A49 is a driver that drives a carriage motor 50 for moving the carriage unit 11, and a motor driver B51 is a driver that drives a conveyance motor 52 for conveying the print medium P.

(3) "Configuration of Print Head"

In the print head 13, a plurality of ejection ports are arrayed in a direction crossing the main scanning direction (perpendicularly in the present example), and the print head 13 comprises a plurality of ejection port arrays (corresponding to nozzle arrays) formed of these ejection ports. To eject the inks from these ejection ports, the print head 13 comprises ejection energy generation elements for the respective ejection ports. Elements such as electro-thermal conversion elements or piezoelectric elements can be used as the ejection energy generation elements. In the present example, electro-thermal conversion elements are used as the ejection energy generation elements (hereinafter also referred to as "ejection heaters"). By causing the ejection heaters to generate heat and thus forming bubbles in the inks, the inks are ejected from the ejection ports with the bubble forming energy.

Figure 3:
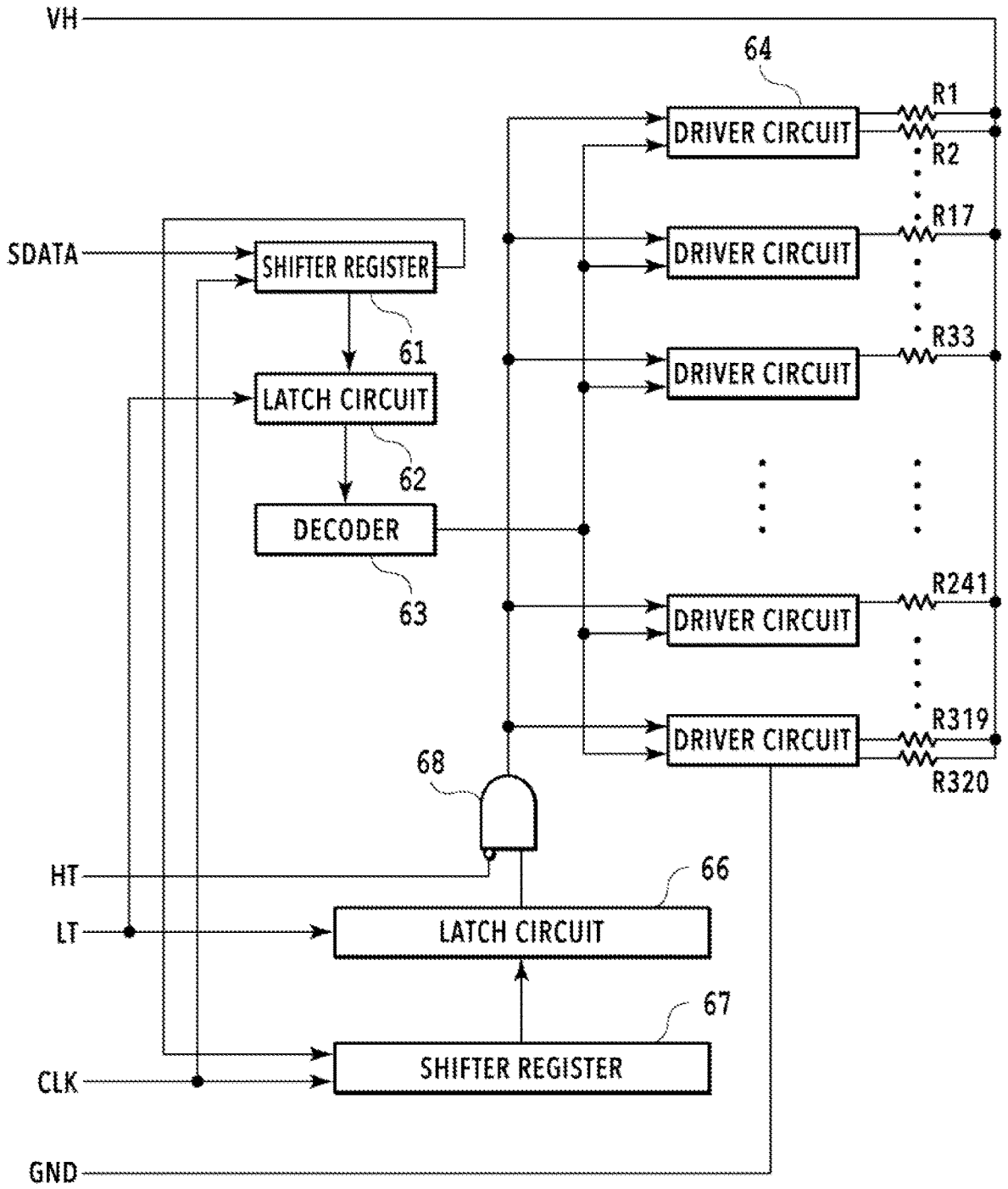
FIG. 3 is an explanatory diagram of the basic configuration of an electric circuit in a print head.

FIG. 3 is a block diagram for explaining the basic configuration of an electric circuit in the print head 13. A circuit board (heater board) of the print head 13 incorporates a total of 320 ejection heaters R1 to R320 and their drive circuits. In the present example, these ejection heaters R1 to R320 are divided into a total of 15 blocks of 16 ejection heaters, and a driver circuit 64 is connected to each block. Serial data (SDATA) for the ejection heaters is aligned by shift registers 61 and 67 in synchronization with a clock (CLK). In the serial data (SDATA), the numbers of the ejection heater blocks are latched in a latch circuit 62 in accordance with a latch signal (LT), and ejection data for the ejection heaters in each block is latched in a latch circuit 66 in accordance with the latch signal (LT). The ejection data latched in the latch circuit 66 is inputted into one of the input terminals of an AND gate 68. A heat signal (HT) is an enable signal for specifying the duration of drive (energization) of the ejection heaters and is inputted into the other input terminal of the AND gate 68. The numbers of the ejection heater blocks (block numbers) latched in the latch circuit 62 are sequentially decoded by a decoder 63. The driver circuits 64 are a transistor array for power supply control connected to a power supply line for the ejection heater drive voltage (VH), and turn on and off the energization of the ejection heaters R1 to R320.

Figure 4A:
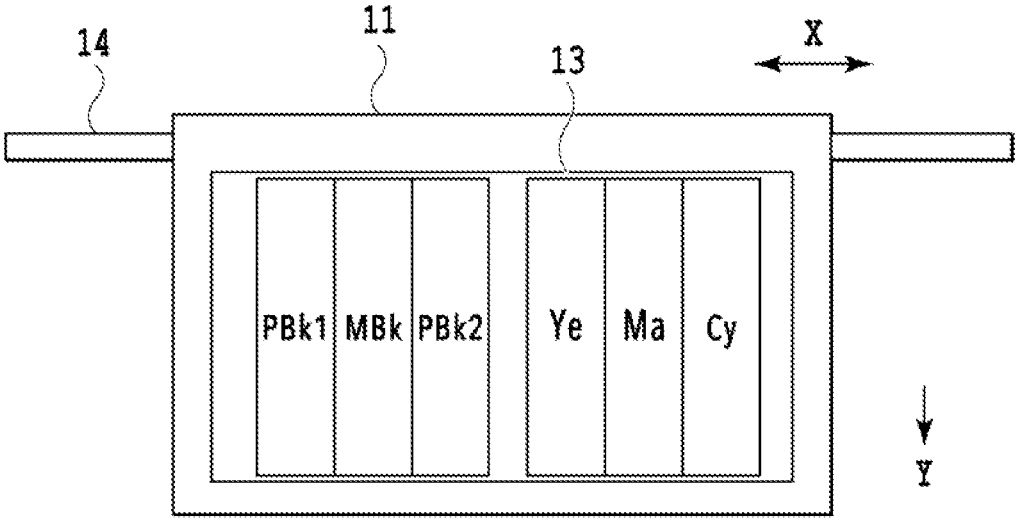
FIG. 4A is an explanatory diagram of the nozzle configuration of the print head in the first embodiment of the present invention.
Figure 4B:
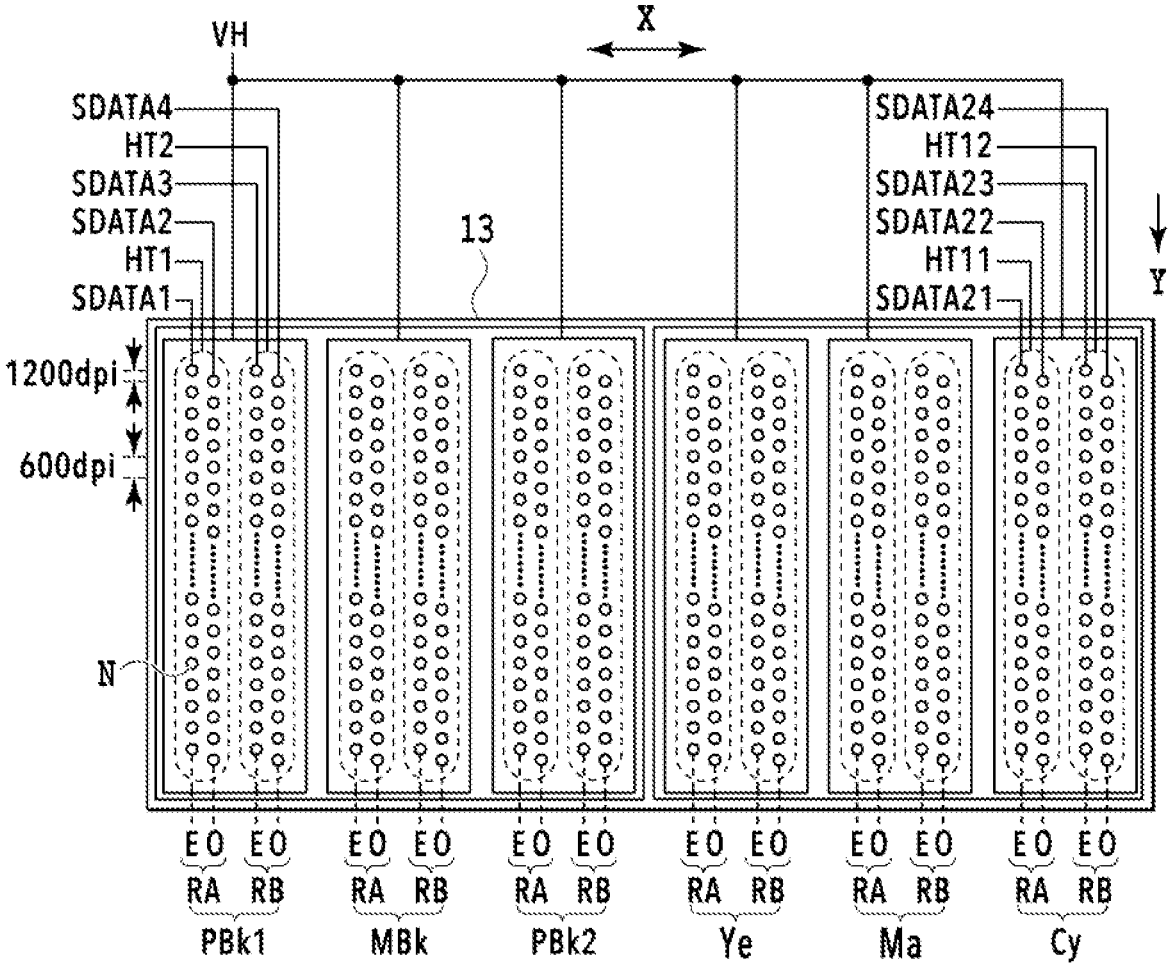
FIG. 4B is an explanatory diagram of nozzle groups in the print head in FIG. 4A.

FIG. 4A is an explanatory diagram of the nozzle configuration of the print head 13, and FIG. 4B is an explanatory diagram of control signals that control the nozzle arrays for the respective ink colors. In the present example, a nozzle group is formed for each ink (PBk1, MBk, PBk2, Ye, Ma, Cy), as illustrated in FIG. 4A. FIG. 4B is an enlarged diagram for explaining these nozzle groups.

In the print head 13 in the present example, a plurality of nozzles N each including an ejection port and an ejection energy generation element and being capable of ejecting an ink are arrayed linearly in the direction of arrow Y to form a single nozzle array. For each ink color, four nozzle arrays are arranged in the direction of arrow X to form a nozzle group. In a nozzle group PBk1 for the black ink, there are formed a nozzle array RA including two nozzle arrays (even numbered array E and odd numbered array O) and a nozzle array RB including two nozzle arrays (even numbered array E and odd numbered array O). In each of the nozzle arrays RA and RB, the nozzles N in each of the even numbered array E and the odd numbered array O are arrayed at intervals corresponding to a resolution of 600 dpi, and the nozzles N in the even numbered array E and the nozzles N in the odd numbered array O are shifted from each other by a distance corresponding to a resolution of 1200 dpi. Serial data (SDATA1) is serial data for the even numbered array E in the nozzle array RA, and serial data (SDATA2) is serial data for the odd numbered array O in the nozzle array RA. Also, serial data (SDATA3) is serial data for the even numbered array E in the nozzle array RB while serial data (SDATA4) is serial data for the odd numbered array O in the nozzle array RB. The even numbered array E and the odd numbered array O in the nozzle array RA are controlled by a single heat signal (HT1), and the even numbered array E and the odd numbered array O in the nozzle array RB are controlled by a single heat signal (HT2).

The nozzle groups MBk, PBk2, Ye, Ma, and Cy for the other inks are configured similarly to the nozzle group PBk1 for the black ink. In the example of FIG. 4B, two nozzle groups PBk1 and PBk2 are formed as the nozzle group PBk for the black ink. As described above, a plurality of groups of nozzles may be formed for an ink of the same color, and that ink is not limited only to the black ink. The ejection heater drive voltage (VH) is supplied to the nozzle group for the ink of each color. In the present example, a common ejection heater drive voltage (VH) is supplied to the nozzle group for the ink of each color.

In the following description, the total of 24 nozzle arrays in FIG. 4B will be referred to as "first nozzle array", "second nozzle array", "third nozzle array", . . . , "24th nozzle array" from the left side to the right side in FIG. 4B. For example, the even numbered array E in the nozzle array RA in the nozzle group PBk1 is the "first nozzle array", the odd numbered array O in that nozzle array RA is the "second nozzle array", and the odd numbered array O in the nozzle array RB in the rightmost nozzle group Cy in FIG. 4B is the "24th nozzle array".

(4) "Configuration for Detecting Breakage"

Figure 5A:
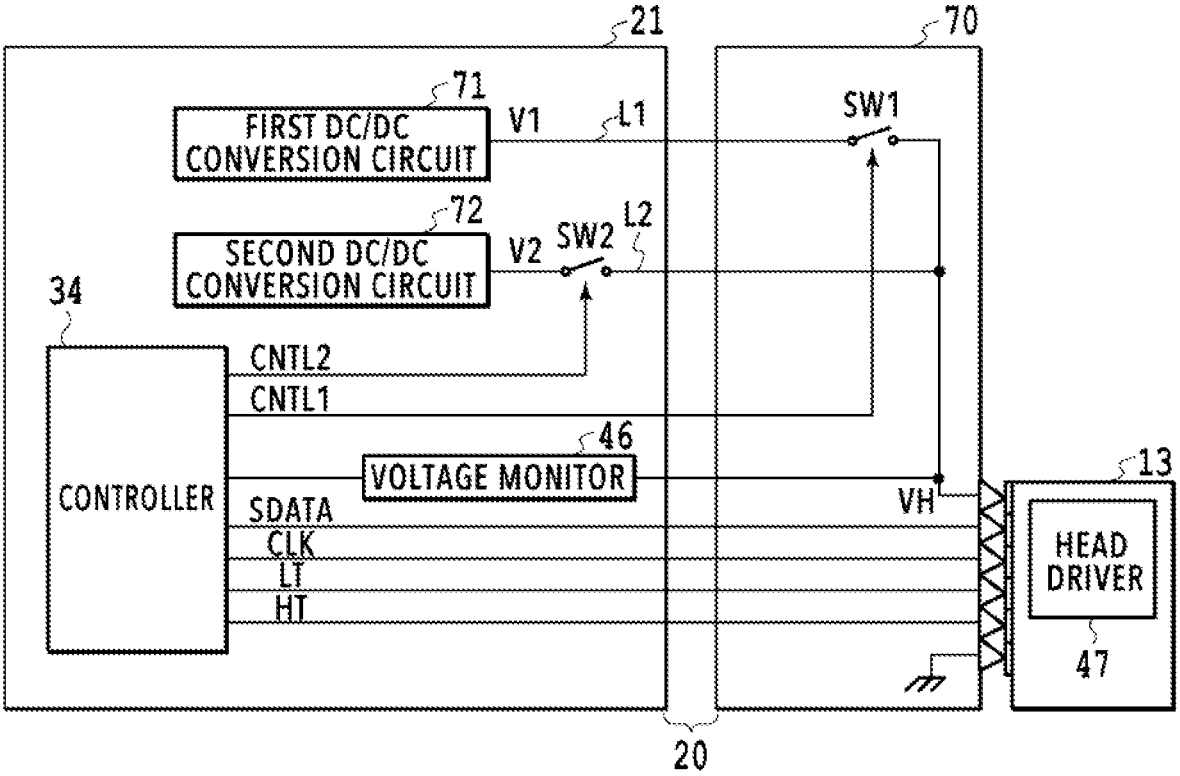
FIG. 5A is an explanatory diagram of an example configuration of a circuit for detecting breakage in an FFC in the first embodiment of the present invention.

FIG. 5A is a block diagram for explaining an example configuration of a circuit for detecting breakage in the FFC 20 (see FIG. 1A). The circuit boards mounted on the printing apparatus include the main circuit board 21 (see FIG. 1B) and a carriage circuit board 70 mounted on the carriage unit 11. By being attached to the carriage unit 11, the print head 13 is electrically connected to the carriage circuit board 70 and electrically connected further to the main circuit board 21 through the FFC 20.

In a normal printing operation, a first voltage (V1) is supplied to the print head 13 from a first DC/DC conversion circuit 71 through the carriage circuit board 70. A first power supply line L1 through which to supply the first voltage (V1) comprises a first switch SW1 formed with a semiconductor transistor or the like. This enables switching on and off of the supply of the first voltage (V1) to the print head 13. The first switch SW1 is controlled by a first control signal (CNTL1) supplied from the controller 34. The first voltage (V1) is used in a normal printing operation as an ejection heater drive voltage (VH) that drives the ejection heaters 48 to eject the inks from the nozzles in the print head 13.

Also, to detect breakage in the FFC 20, a second voltage (V2) lower than the first voltage (V1) is supplied to the print head 13 through the carriage circuit board 70. To detect breakage in FFC 20, the second voltage (V2) is used as an ejection heater drive voltage (VH) that drives the ejection heaters 48 to such an extent that the inks are not ejected from the nozzles in the print head 13. The second voltage (V2) may be supplied from an AC/DC conversion circuit or a DC/DC conversion circuit through a regulator or supplied from a DC/DC conversion circuit. In the example of FIG. 5A, the second voltage (V2) is supplied from a second DC/DC conversion circuit 72. A second power supply line L2 to which the second DC/DC conversion circuit 72 is connected comprises a second switch SW2 formed with a semiconductor transistor or the like. This enables switching off and on of the supply of the second voltage (V2) to the print head 13. The second switch SW2 is controlled by a second control signal (CNTL2) supplied from the controller 34.

The ejection heater drive voltages (VH) supplied to the print head 13 through the first and second power supply lines L1 and L2 are monitored by the voltage monitor (voltage detection unit) 46, and the result of the monitoring is outputted to the controller 34. The voltage monitor 46 can be implemented by a function incorporated in the controller 34. Control signals for controlling the drive of the nozzles are supplied from the controller 34 to the print head 13 through the FFC 20 and the carriage circuit board 70. These control signals include serial data (SDATA), a clock signal (CLK), a latch signal (LT), and heat signals (HT). The plurality of wirings formed in the FFC 20 include signals lines for these control signals. With these control signals, the nozzles execute a drive operation for ejecting the inks.

Figure 5B:
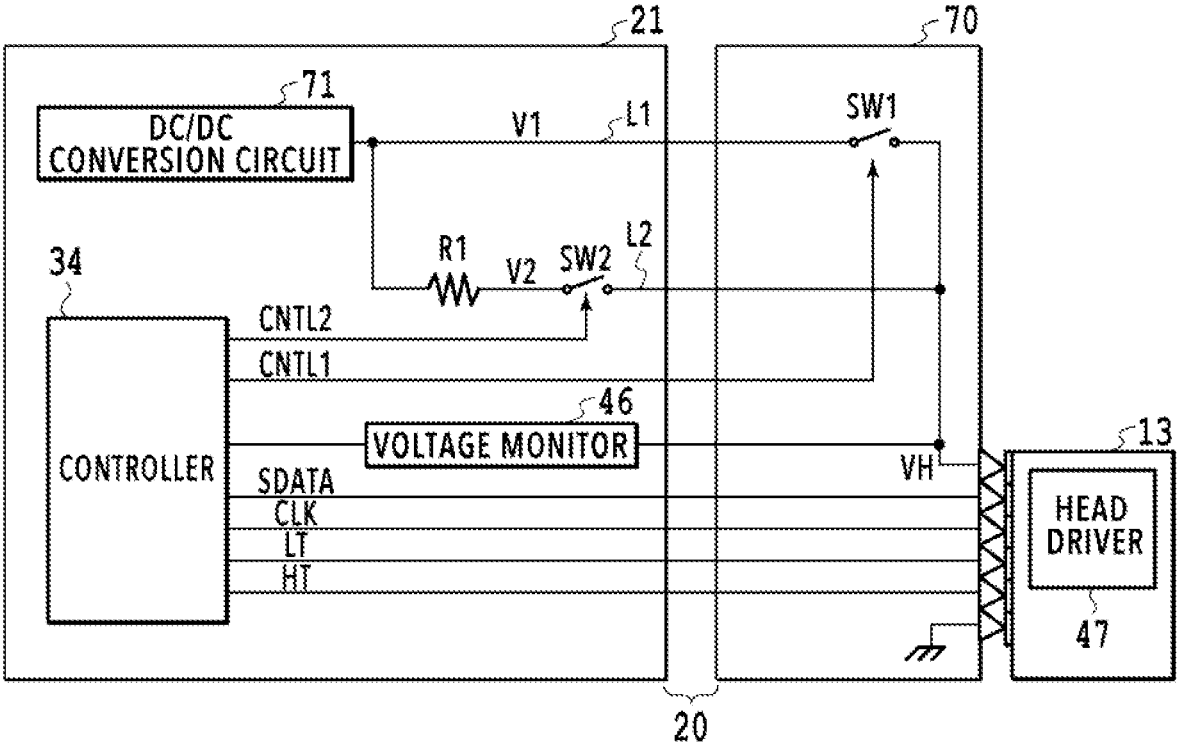
FIG. 5B is an explanatory diagram of another example configuration of the circuit for detecting breakage in the FFC in the first embodiment of the present invention.

FIG. 5B is a block diagram for explaining another example configuration of the circuit for detecting breakage in the FFC 20. The foregoing example configuration in FIG. 5A comprises the DC/DC conversion circuit 72 as the supply source of the second voltage (V2), which is lower than the first voltage (V1). In the example configuration in FIG. 5B, a supply circuit with a resistor R1 connected to the DC/DC conversion circuit 71, which is the supply source of the first voltage (V1), is used as the supply source of the second voltage (V2). In the present example, the resistor R1 is connected to the single DC/DC conversion circuit 71 to form a supply source having a lower capability to supply drive power than the supply source of the first voltage (V1). In other words, the second power (V2) as a supply power lower than the first voltage (V1) is supplied to the print head 13 through L2. Note that the resistor R1 has a resistance larger than the resistance of the ejection heaters 48 in the print head 13. This is because, as described later, the resistor R1 affects the accuracy of a voltage monitor value used to determine whether there is breakage in the FFC 20.

Figure 6:
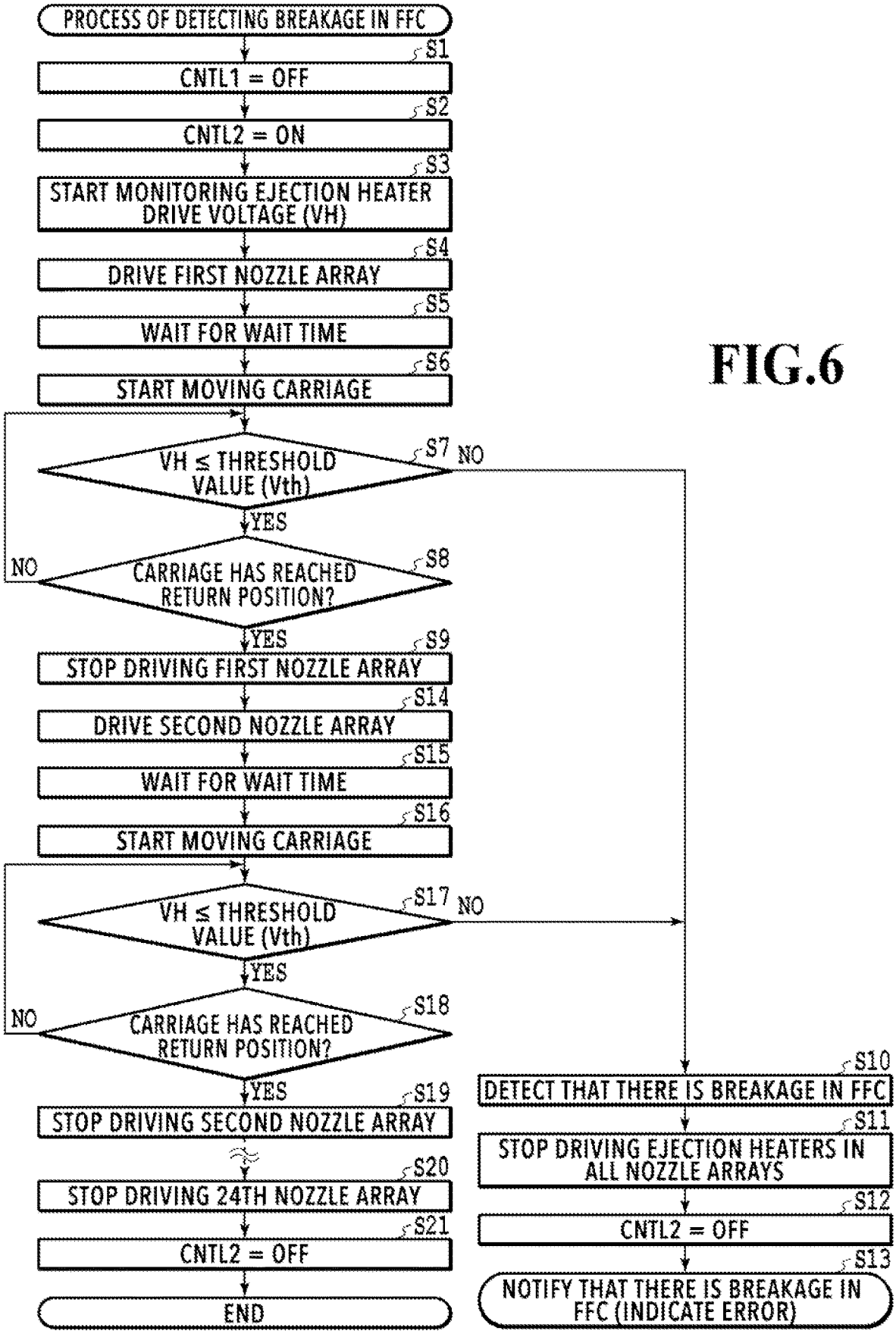
FIG. 6 is a flowchart for explaining a process of detecting breakage in the FFC in the first embodiment of the present invention.

FIG. 6 is a flowchart for explaining processing during an operation of detecting breakage in the FFC 20 (breakage detection process). The CPU 35 performs this breakage detection process by executing a control program stored in the ROM 36 in the state where the print head 13 is attached to the carriage unit 11. Alternatively, the functions of some or all of the steps in FIG. 6 may be implemented with hardware such as an ASIC or an electronic circuit. Meanwhile, the symbol "S" in the description of each process in FIG. 6 means a step in the flowchart of FIG. 6.

Firstly, the CPU 35 turns off the first switch SW1 with the first control signal (CNTL1) (S1) and then turns on the second switch SW2 with the second control signal (CNTL2) (S2). As a result, the second voltage (V2) is supplied as the ejection heater drive voltage (VH) to the print head 13 through the power supply line L2. Then, the monitoring of the ejection heater drive voltage (VH) in the print head 13 with the voltage monitor 46 is started (S3), so that the voltage value of the ejection heater drive voltage (VH) is detected in the subsequent sequence. Thereafter, the CPU 35 drives the first nozzle array in the print head 13 (the even numbered array E in the nozzle array RA in the nozzle group PBk1) on the basis of a heat signal (HT) (S4), and waits for a wait time for the ejection heater drive voltage (VH) to stabilize (stabilizing time) (S5). Then, while monitoring the ejection heater drive voltage (VH), the CPU 35 starts moving the carriage unit 11 (S6) and, at the same time, drives the first nozzle array to eject the ink. The CPU 35 compares the ejection heater drive voltage (VH) with a threshold value (Tth) until the carriage unit 11 reaches the return position in the direction of the movement (S7 and S8).

The threshold value (Tth) is a predetermined voltage lower than the second voltage (V2), which is the ejection heater drive voltage (VH). As the head driver 47 drives each ejection heater 48 such that the second voltage (V2) is applied thereto and a current flows through the ejection heater 48, the second voltage (V2) drops to or below the threshold value (Tth). In the case where the second voltage (V2), which is the ejection heater drive voltage (VH), is lower than or equal to the threshold value (Tth), it is possible to determine that the drive target nozzle array is properly driven and the wirings for the nozzle array have not been broken. On the other hand, in the case where the second voltage (V2), which is the ejection heater drive voltage (VH), is higher than the threshold value (Tth), it is possible to determine that a wiring for the drive target nozzle array has been broken.

If the second voltage (V2), which is the ejection heater drive voltage (VH), is higher than the threshold value (Vth) in the comparison in S7, the CPU 35 detects that there is breakage in the FFC 20 (S10), and stops driving the ejection heaters in all nozzle arrays (S11). Thereafter, the CPU 35 turns off the second switch SW2 with the second control signal (CNTL2) (S12) and then reports the occurrence of breakage in the FFC 20 to the user by using the display panel unit 6 (see FIG. 1A) or the like (S13). At the time of the notification, for example, a particular lamp (not illustrated) provided to the operation display unit 40 (see FIG. 2) may also be turned on to alert the user. The reporting of the result of the detection of breakage in the FFC 20 may be done not only on the printing apparatus by an error indication as above but also on the host apparatus 38 (see FIG. 2), connected to the printing apparatus.

If determining in S7 that the ejection heater drive voltage (VH) is lower than or equal to the threshold value (Vth) and determining in S8 that the carriage unit 11 has reached the return position, the CPU 35 stops driving the drive target nozzle array in S4 (S9). In other words, the CPU 35 determines that the wirings for the first nozzle array among the wirings in the FFC 20 have not been broken, and stops driving that nozzle array.

Then, the CPU 35 determines whether any of the wirings for the second nozzle array (the odd numbered array O in the nozzle array RA in the nozzle group PBk1), which is next to the first nozzle array, has been broken. To do so, the CPU 35 drives only the second nozzle array (S14). The processes in S14 to S19 are similar to the above-described processes in S4 to S9 except that the drive target nozzle array is changed from the first nozzle array to the second nozzle array, and description thereof is therefore omitted.

Thus, similar processes to the above-described processes in S4 to S9 are executed on the other nozzle arrays. Specifically, after the second nozzle array, the drive target nozzle array is changed to the third nozzle array (the even numbered array E in the nozzle array RB in the nozzle group PBk1), the fourth nozzle array (the odd numbered array O in the nozzle array RB in the nozzle group PBk1), and so on. Then, while sequentially driving these nozzle arrays, the CPU 35 determines whether any of the wirings for the nozzle array has been broken. The last drive target nozzle array is the 24th nozzle array (the odd numbered array O in the nozzle array RB in the nozzle group Cy). If determining that the wirings for the 24th nozzle array have not been broken, the CPU 35 stops driving that nozzle array (S20), and turns off the second switch SW2 with the second control signal (CNTL2) (S21) to terminate the breakage detection process.

In the present embodiment, whether there is breakage is detected for all the wirings in the FFC 20 allocated to the ejection heaters in each nozzle array. Also, by moving the carriage unit 11 during the breakage detection process, breakage can be detected while the bend of the FFC 20 is changed. Hence, even in a case where broken portions of a wiring are connected or disconnected depending on the state of the FFC 20, that breakage is reliably detected. Also, the breakage is detected more reliably by setting the range of movement of the carriage unit 11 to the full possible range of movement, as in the present example.

Figure 7:
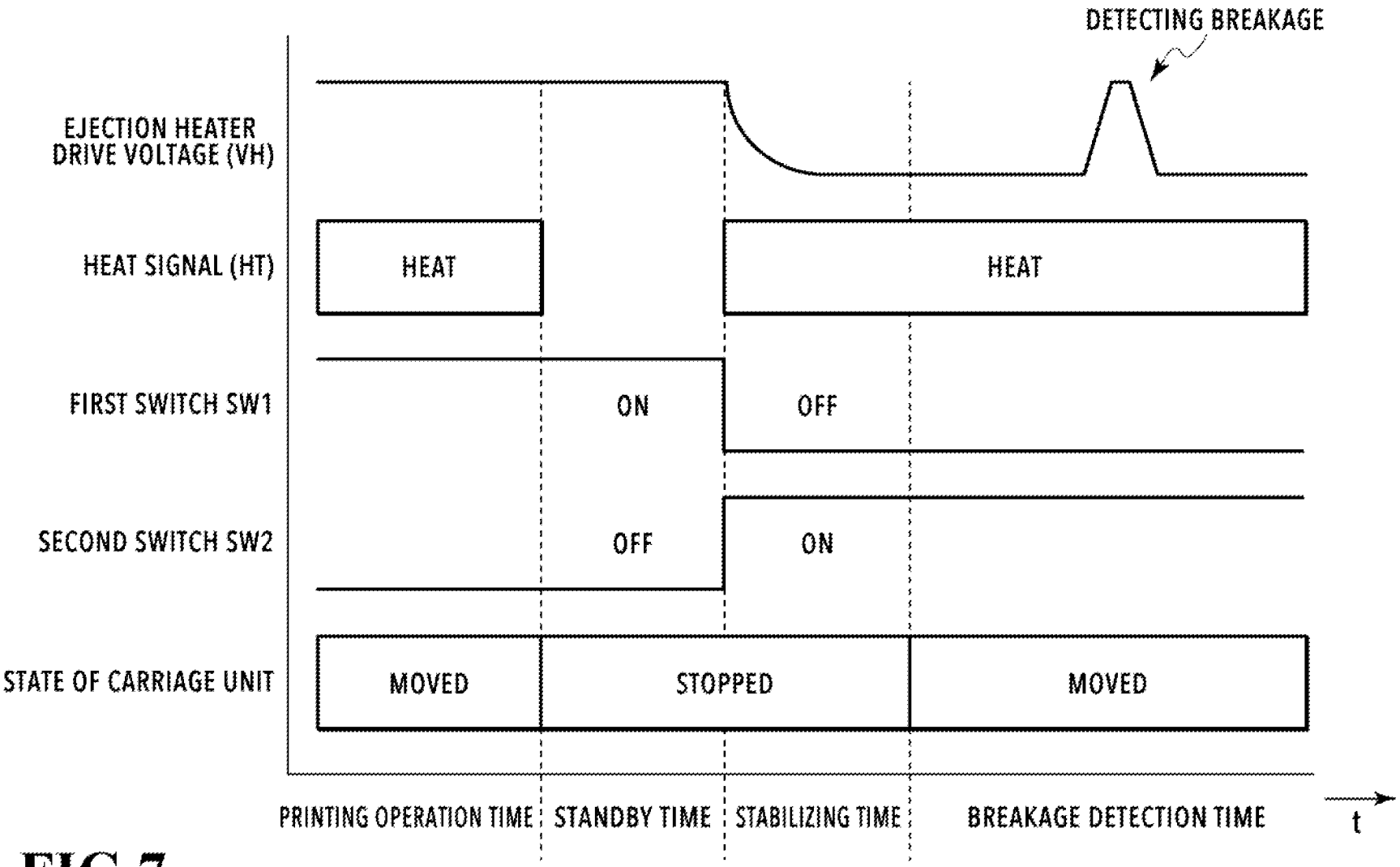
FIG. 7 is an explanatory diagram of signal waveforms during the execution of the breakage detection process in FIG. 6.

FIG. 7 is an explanatory diagram of signal waveforms during the execution of the process of detecting breakage in the FFC 20. During each printing operation and during standby for a printing operation (during a non-printing operation), the first switch SW1 is turned on and the second switch SW2 is turned off, so that the ejection heater drive voltage (VH) is the first voltage (V1).

To execute the process of detecting breakage in the FFC 20, the first switch SW1 is turned off and the second switch SW2 is turned on (S1 and S2), as mentioned earlier. As each ejection heater 48 is driven in the above state on the basis of serial data (SDATA), the clock signal (CLK), the latch signal (LT), and the heat signal (HT), the ejection heater drive voltage (VH) shifts to the second voltage (V2), which is lower than the normal first voltage (V1). In FIG. 7, only the heat signal (HT) is illustrated to represent these signals. The stabilizing time in FIG. 7 is a transition period for the ejection heater drive voltage (VH) to stabilize from the first voltage (V1) to the second voltage (V2), and corresponds to the wait time in S5 in FIG. 6. After the ejection heater drive voltage (VH) shifts to the second voltage (V2) (S5), the carriage unit 11 starts moving (S6), and the operation shifts to a time for detecting breakage in the FFC 20. In this breakage detection time, if the second voltage (V2), which is the ejection heater drive voltage (VH), becomes higher than the predetermined threshold value (Vth), a wiring for the drive target nozzle array at that moment is determined to be in a broken state.

The above-described sequence for detecting breakage in the FFC 20 may be executed as a dedicated sequence that causes the carriage unit 11 to move 24 times to perform the breakage detection on the wirings for the ejection heaters in all 24 nozzle arrays as in FIG. 4B. Also, such a breakage detection sequence may be executed simultaneously with a sequence for detecting the width of the print medium by using the optical sensor 22 (see FIG. 1B) on the carriage unit 11 or the like. Also, the sequence for detecting breakage in the FFC 20 may be executed at the same time as when the carriage unit 11 is moved during an initial operation for starting the printing apparatus. Thus, the sequence for detecting breakage in the FFC 20 may be executed simultaneously with various non-printing operations in which the carriage unit 11 is moved for purposes other than printing. In the sequence for detecting the width of the print medium, the carriage unit 11 is moved forward and backward only once. For this reason, the breakage detection can be executed only on the wirings for a total of two nozzle arrays by the forward movement and the backward movement. In this case, the breakage detection may be sequentially executed on the wirings for the other nozzle arrays, starting for example from the nozzle array next to the nozzle array that finished the last breakage detection, in the next and subsequent non-printing operations in which the carriage unit 11 is moved. Also, the sequence for detecting breakage in the FFC 20 may be executed while the printing apparatus is started or executed on the basis of an instruction from the operator.

As described above, in the present embodiment, it is possible to perform breakage detection on the wirings for each nozzle array in the print head with a simple configuration, without a complicated circuit or the like. Meanwhile, the timing to execute the process of detecting breakage in the FFC is not limited to during movement of the carriage unit, as in the present embodiment, but the process may be executed in a state where the carriage unit is stopped.

Second Embodiment

In the foregoing first embodiment, in a case where breakage of a wiring for ejection heaters is detected, the user is immediately notified of that breakage as an error. Hence, the broken wiring is not identified. Accordingly, whether there is breakage is determined quickly. In a second embodiment of the present invention, the broken wiring is identified.

Figures 8, 8A:
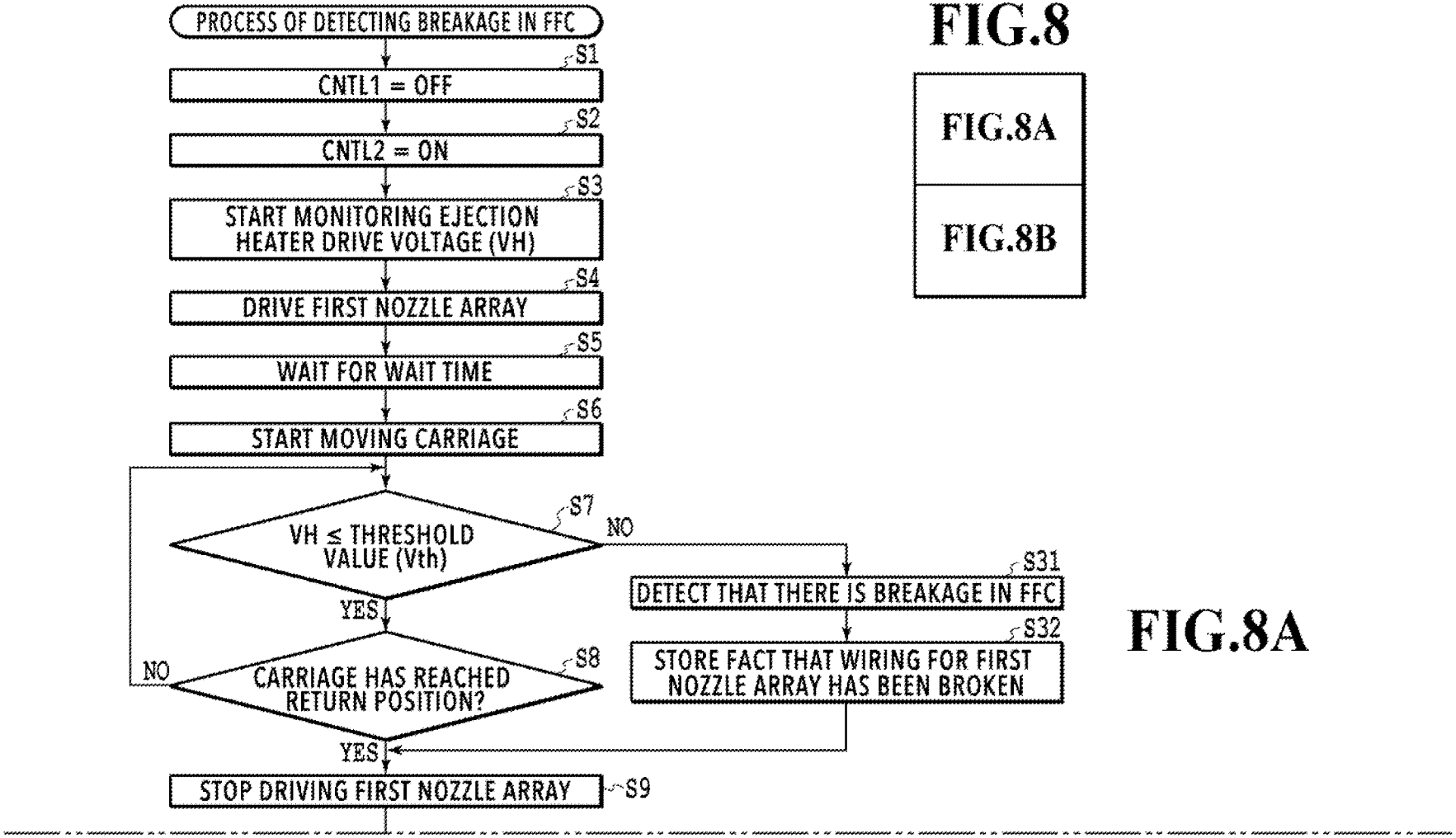
FIG. 8 is a diagram showing a relation between FIGS. 8A and 8B.
FIGS. 8A and 8B are flowcharts for explaining a process of detecting breakage in an FFC in a second embodiment of the present invention.
Figure 8B:
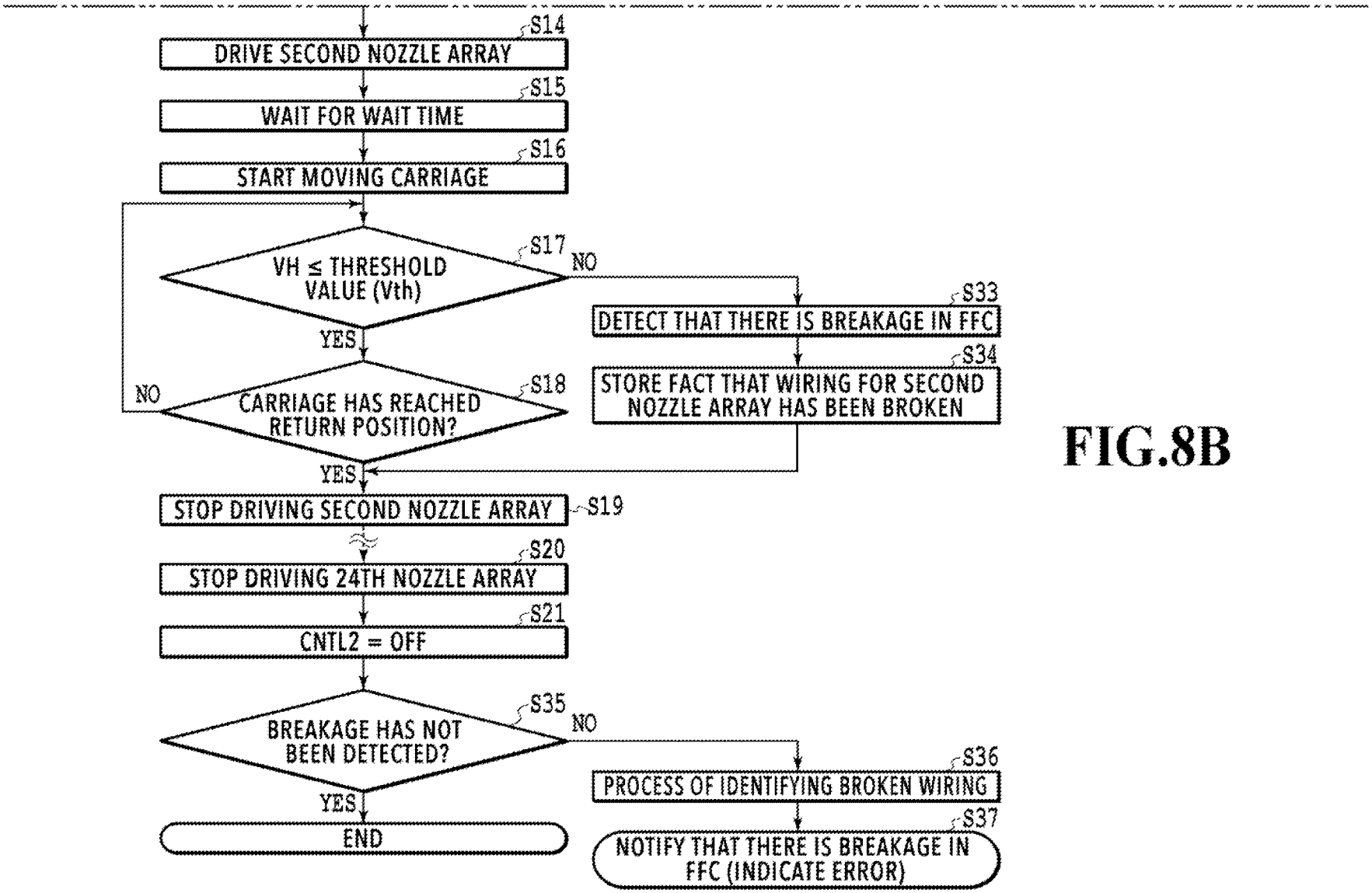

FIGS. 8A and 8B are flowcharts for explaining a process of detecting breakage in the FFC in the present embodiment. The CPU 35 performs the process by executing a control program stored in the ROM 36. Similar steps to steps in FIG. 6 in the foregoing embodiment are denoted by S with the identical numbers, and description thereof is omitted.

Firstly, the CPU 35 sets the first nozzle array (the even numbered array E in the nozzle array RA in the nozzle group PBk1) as the drive target, and compares the second voltage (V2), which is the ejection heater drive voltage (VH), with the threshold value (Tth) until the carriage unit 11 reaches the return position (S7 and S8). If the ejection heater drive voltage (VH) is higher than the threshold value (Vth) in S7, the CPU 35 determines that there is breakage in the FFC 20 (S31), and stores information indicating that a wiring for the first nozzle array has been broken in the RAM 37 (see FIG. 2) (S32). Then, the CPU 35 proceeds to S9.

Thereafter, the CPU 35 drives the second nozzle array (the odd numbered array O in the nozzle array RA in the nozzle group PBk1), and compares the second voltage (V2), which is the ejection heater drive voltage (VH), with the threshold value (Tth) until the carriage unit 11 reaches the return position (S17 and S18). The processes in S14 to S19, S33, and S34 are similar to the above-described processes in S4 to S9, S31, and S32 except that the drive target nozzle array is changed, and description thereof is therefore omitted.

Thus, similar processes to the above-described processes in S14 to S19, S33, and S34 are executed on the other nozzle arrays. The CPU 35 sequentially changes the drive target nozzle array and determines whether any of the wirings for the drive target nozzle array has been broken. The last drive target nozzle array is the 24th nozzle array (the odd numbered array O in the nozzle array RB in the nozzle group Cy). If determining that the wirings for the 24th nozzle array have not been broken, the CPU 35 stops driving that nozzle array (S20), and turns off the second switch SW2 with the second control signal (CNTL2) (S21) to stop supplying the drive power to the print head 13.

Thereafter, the CPU 35 determines whether there has been any wiring determined to be broken among the wirings in the FFC for all the drive target nozzle arrays (S35). If none of the wirings has been determined to be broken, the CPU 35 terminates the sequence for detecting breakage in the FFC. If there has been even one wiring determined to be broken, the CPU 35 proceeds to S36, in which it executes a process of identifying the broken wiring as described later (S36), and notifies the user of the identified wiring with the display panel unit 6 or the like (error indication). At the time of the notification, for example, a particular lamp (not illustrated) provided to the operation display unit 40 (see FIG. 2) may also be turned on to alert the user. The notification of the occurrence of breakage in the FFC 20 may be done not only on the printing apparatus by an error indication as above but also on the host apparatus 38 (see FIG. 2), connected to the printing apparatus.

FIG. 9 is an explanatory diagram of the process of identifying the broken wiring (S36 in FIG. 8A). In the following, a description will be exemplarily given of a case where a wiring for at least one of the first and second nozzle arrays (the even numbered array E and the odd numbered array O in the nozzle array RA in the nozzle group PBk1) has been broken. In FIG. 9, "OK" means that none of the wirings for the nozzle array have been detected to be broken, whereas "NG" means that a wiring for the nozzle array has been detected to be broken.

In the case where breakage of only a wiring for the first nozzle array has been detected, the CPU 35 determines that the wiring for the serial data (SDATA1) for the first nozzle array (see FIG. 4B) has been broken. In the case where breakage of only a wiring for the second nozzle array has been detected, the CPU 35 determines that the wiring for the serial data (SDATA2) for the second nozzle array (see FIG. 4B) has been broken. In the case where breakage of a wiring for both the first nozzle array and the second nozzle array has been detected, the CPU 35 determines that the wiring for the heat signal (HT1), which is shared by the first and second nozzle arrays (see FIG. 4B), has been broken. In the case where breakage of wirings for all nozzle arrays including the first and second nozzle arrays have been detected, the CPU 35 determines that the wirings for the clock signal (CLK) and the latch signal (LT), which are shared by all nozzle arrays, have been broken. Thus, the CPU 35 identifies the broken wiring(s) in accordance with the detection result of the breakage detection process.

As with the first and second nozzle arrays, whether the wiring for the serial data (SDATA) has been broken or the wiring for the heat signal (HT) has been broken can be determined for the other nozzle arrays. In other words, as with the first and second nozzle arrays, the broken wiring can be identified for the other nozzle arrays.

As described above, in the present embodiment, a broken wiring in the FFC can be identified. Then, in a case where a plurality of FFCs are connected to the print head, it is possible to identify an FFC with breakage. In this case, information on the particular FFC with the breakage may be displayed by using the display panel unit 6 (see FIG. 1A) or the like. In this way, it is possible to replace only the FFC with the breakage and continue using each of the other FFCs as is.

Third Embodiment

Figure 10:
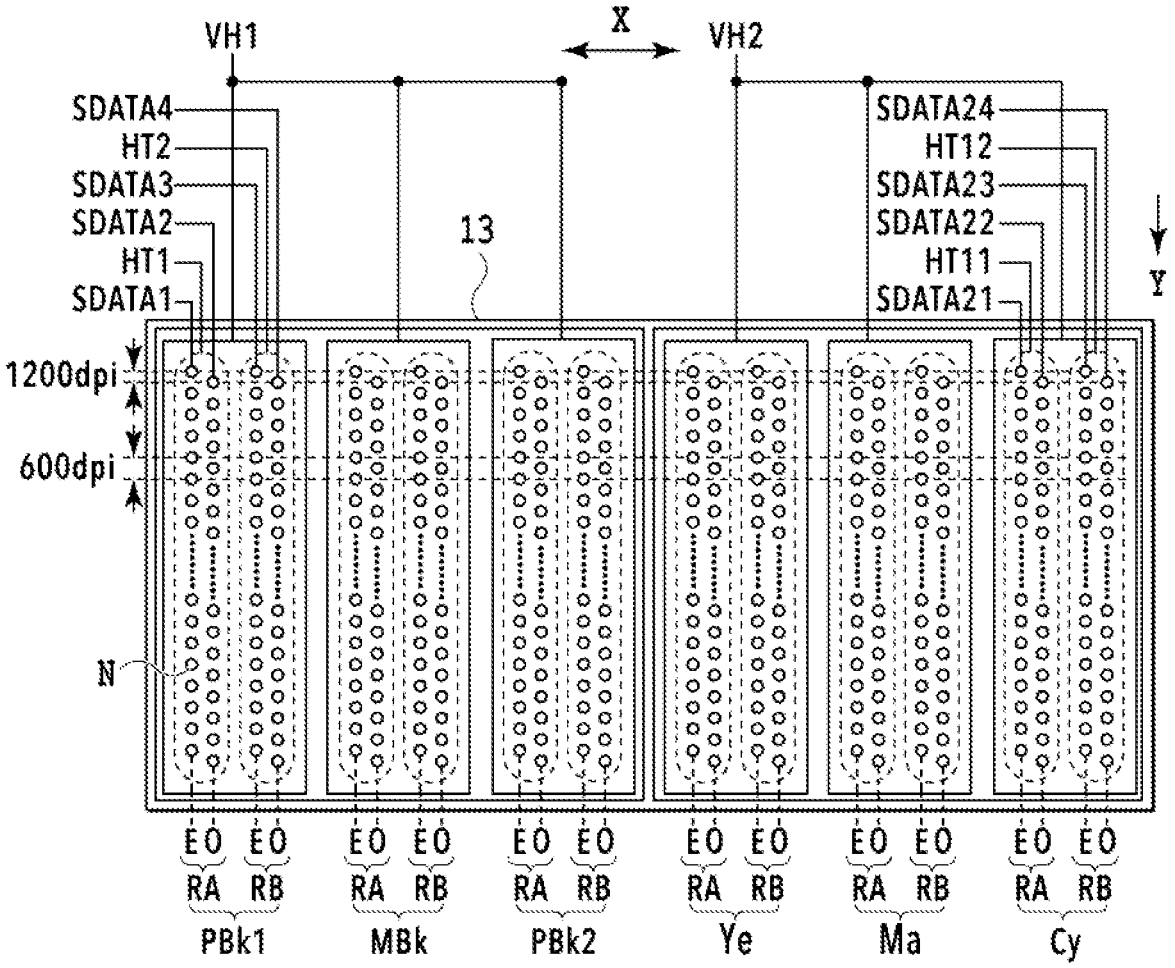
FIG. 10 is an explanatory diagram of a print head in a third embodiment of the present invention.

In the present embodiment, wirings are connected as illustrated in FIG. 10 to a print head 13 in which nozzle groups (PBk1, MBk, PBk2, Ye, Ma, and Cy) are formed as illustrated in FIGS. 4A and 4B in the foregoing first embodiment. The relation of connection between the wirings for the serial data (SDATA) and the heat signal (HT) and each nozzle array are similar to that in the foregoing first embodiment, and description thereof is therefore omitted. The ejection heater drive voltage (VH) in the present embodiment is classified into an ejection heater drive voltage (VH1) to be supplied to a group including the nozzle groups PBk1, MBk, and PBk2 and an ejection heater drive voltage (VH2) to be supplied to a group including the nozzle groups Ye, Ma, and Cy.

Figure 11A:
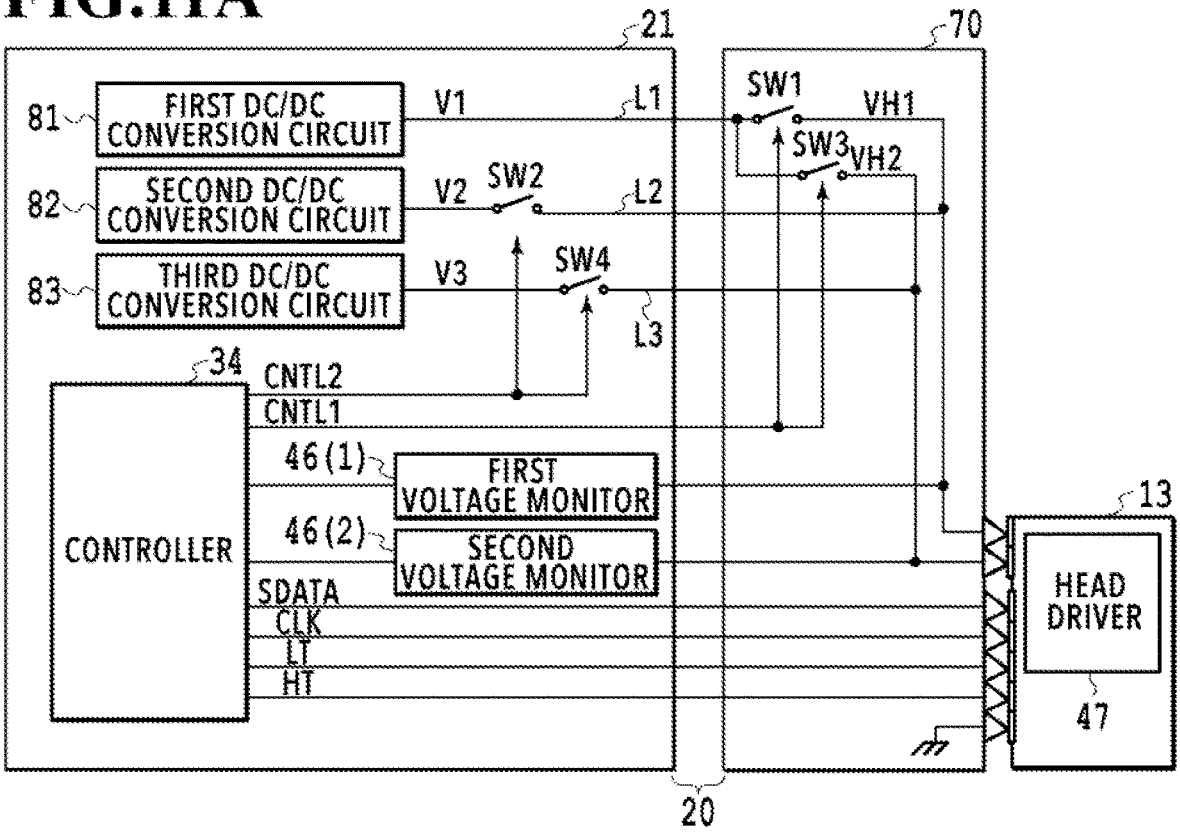
FIG. 11A is an explanatory diagram of an example configuration of a circuit for detecting breakage in an FFC in the third embodiment of the present invention.

FIG. 11A is a block diagram for explaining an example configuration of a circuit for detecting breakage in the FFC 20 (see FIG. 1B). As in the foregoing first embodiment, the circuit boards mounted on the printing apparatus include the main circuit board 21 (see FIG. 1B) and the carriage circuit board 70 mounted on the carriage unit 11. By being attached to the carriage unit 11, the print head 13 is electrically connected to the carriage circuit board 70 and electrically connected further to the main circuit board 21 through the FFC 20.

In a normal printing operation, a first voltage (V1) is supplied to the print head 13 from a first DC/DC conversion circuit 81 through the FFC 20 and the carriage circuit board 70. A first power supply line L1 through which to supply the first voltage (V1) comprises a first switch SW1 and a third switch S3 each formed with a semiconductor transistor or the like. This enables switching on and off of the supply of the first voltage (V1) to the print head 13. The first switch SW1 and the third switch SW3 are controlled by a first control signal (CNTL1) supplied from the controller 34. The first voltage (V1) is used in a normal printing operation as ejection heater drive voltages (VH1 and VH2) for driving the print head 13.

Also, to detect breakage in the FFC 20, a second voltage (V2) and a third voltage (V3) lower than the first voltage (V1) are supplied to the print head 13 through the FFC 20 and the carriage circuit board 70. The second voltage (V2) is supplied to the group including the nozzle groups PBk1, MBk, and PBk2, and the third voltage (V3) is supplied to the group including the nozzle groups Ye, Ma, and Cy. The second voltage (V2) and the third voltage (V3) to be thus supplied for the respective groups may each be supplied from an AC/DC conversion circuit or a DC/DC conversion circuit through a regulator or supplied from a DC/DC conversion circuit. In the example of FIG. 11A, the second voltage (V2) is supplied from a second DC/DC conversion circuit 82, and the third voltage (V3) is supplied from a third DC/DC conversion circuit 83. The second voltage (V2) and the third voltage (V3) in the present embodiment correspond to the second voltage (V2) in the foregoing embodiments.

The second voltage (V2) and the third voltage (V3), supplied from the DC/DC conversion circuits 82 and 83, correspond to the second voltage (V2) in the foregoing embodiments. As the head driver 47 drives each ejection heater 48 such that the second voltage (V2) and the third voltage (V3) are applied thereto and a current flows through the ejection heater 48, the second voltage (V2) and the third voltage (V3) drop to or below a threshold value (Tth). To the DC/DC conversion circuits 82 and 83, drive power is supplied which exhibits a predetermined voltage drop or more as above when driving each nozzle array. Second and third power supply lines L2 and L3 to which the second and third DC/DC conversion circuits 82 and 83 are connected comprise a second switch SW2 and a fourth switch SW4, respectively, each formed with a semiconductor transistor or the like. This enables switching off and on of the supply of the second voltage (V2) and the third voltage (V3) to the print head 13. The second and fourth switches SW2 and SW4 are controlled by a second control signal (CNTL2) supplied from the controller 34.

The ejection heater drive voltages (VH1 and V2) supplied to the print head 13 through the first and second power supply lines L1 and L2 are monitored by a first voltage monitor 46(1), and the result of the monitoring is outputted to the controller 34. The ejection heater drive voltages (VH2 and V3) supplied to the print head 13 through the first and third power supply lines L1 and L3 are monitored by a second voltage monitor 46(2), and the result of the monitoring is outputted to the controller 34. The voltage monitors 46(1) and 46(2) can be implemented by a function incorporated in the controller 34. As in FIG. 3 in the foregoing first embodiment, serial data (SDATA), a clock signal (CLK), a latch signal (LT), and heat signals (HT) are supplied from the controller 34 to the print head 13 through the carriage circuit board 70.

Figure 11B:
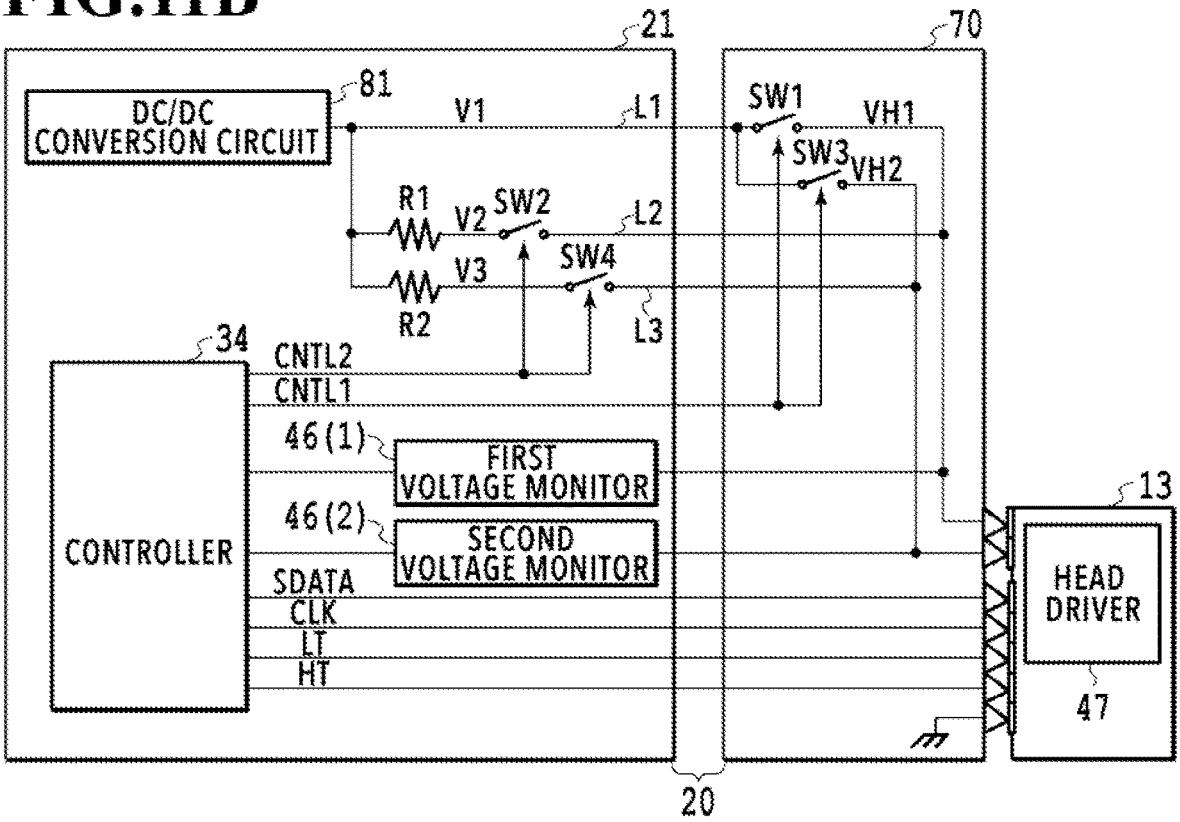
FIG. 11B is an explanatory diagram of another example configuration of the circuit for detecting breakage in the FFC in the third embodiment of the present invention.

FIG. 11B is a block diagram for explaining another example configuration of the circuit for detecting breakage in the FFC 20. The foregoing example configuration in FIG. 11A comprises the DC/DC conversion circuits 82 and 83 as the supply sources of the second voltage (V2) and the third voltage (V3), which are lower than the first voltage (V1). In the example configuration in FIG. 11B, supply circuits with resistors R1 and R2 connected to the DC/DC conversion circuit 81, which is the supply source of the first voltage (V1), are used as the supply sources of the second voltage (V2) and the third voltage (V3). In the present example, the resistors R1 and R2 are connected to the single DC/DC conversion circuit 81 to form a supply source of voltages lower than the first voltage (V1). The resistors R1 and R2 each have a resistance larger than the resistance of the ejection heaters 48 in the print head 13. This is because the resistors R1 and R2 affect the accuracy of a voltage monitor value used to determine whether there is breakage in the FFC 20.

Figures 12, 12A:
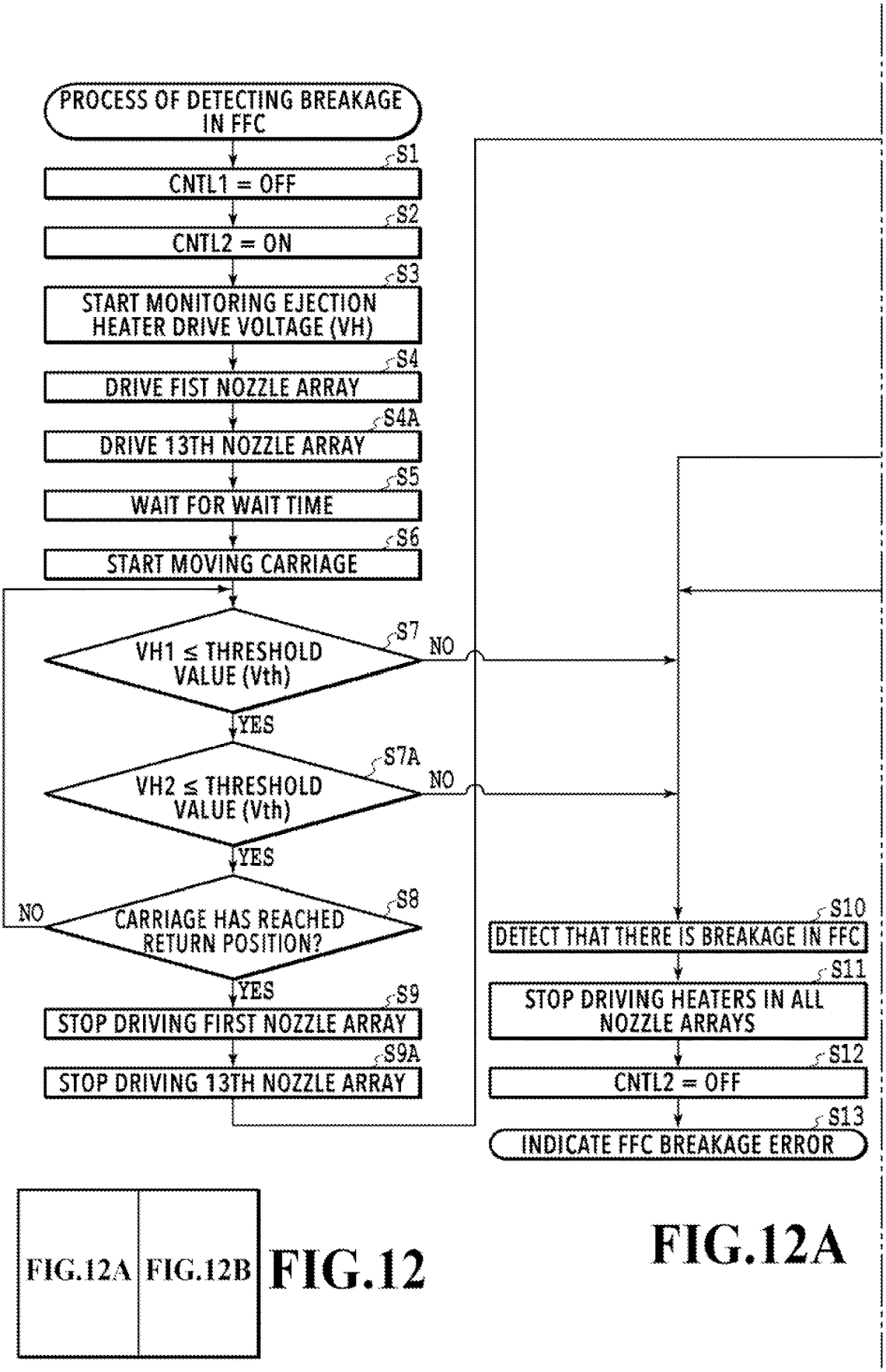
FIG. 12 is a diagram showing a relation between FIGS. 12A and 12B.
FIGS. 12A and 12B are flowcharts for explaining a process of detecting breakage in the FFC in the third embodiment of the present invention.
Figure 12B:
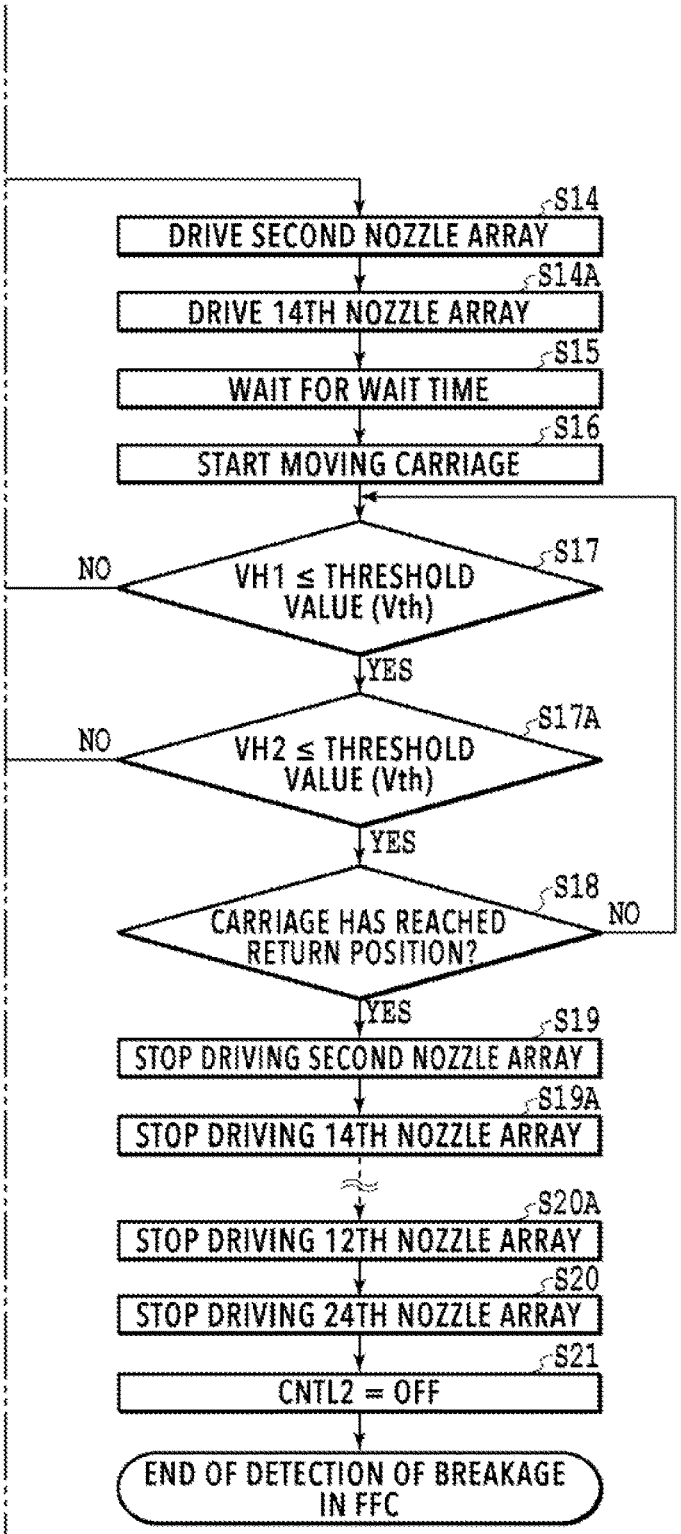

FIGS. 12A and 12B are flowcharts for explaining a process of detecting breakage in the FFC in the present embodiment. The CPU 35 performs the process by executing a control program stored in the ROM 36. Similar steps to steps in FIG. 6 in the foregoing first embodiment are denoted by S with the identical numbers, and description thereof is omitted.

Firstly, the CPU 35 turns off the first and third switches SW1 and SW3 with the first control signal (CNTL1) (S1) and then turns on the second and fourth switches SW2 and SW4 with the second control signal (CNTL2) (S2). As a result, the second and third voltages (V2 and V3) are supplied as the ejection heater drive voltages (VH1 and VH2) to the print head 13 through the power supply lines L2 and L3. Then, the monitoring of the ejection heater drive voltages (VH1 and VH2) in the print head 13 with the voltage monitors 46(1) and 46(2) is started (S3), so that the voltage values of the ejection heater drive voltages (VH1 and VH2) are detected in the subsequent sequence.

Thereafter, the CPU 35 drives the first nozzle array (the even numbered array E in the nozzle array RA in the nozzle group PBk1) and the 13th nozzle array (the even numbered array E in the nozzle array RA in the nozzle group Ye) on the basis of respective heat signals (HT) (S4 and S4A), and waits for a wait time for the ejection heater drive voltages (VH1 and VH2) to stabilize (stabilizing time) (S5). Then, while monitoring the ejection heater drive voltages (VH1 and VH2), the CPU 35 starts moving the carriage unit 11 and, at the same time, drives the first and 13th nozzle arrays (S6). The CPU 35 then compares the second voltage (V2) and the third voltage (V3), which are the ejection heater drive voltages (VH1 and VH2), with the threshold value (Tth) until the carriage unit 11 reaches the return position in the direction of the movement (S7, S7A, and S8). If the ejection heater drive voltage (VH1) and/or (VH2) is higher than the threshold value (Vth), the CPU 35 detects that a wiring in the FFC 20 for the first and/or 13th nozzle array has been broken, and proceeds to the process in S13 from S10. In S12, the CPU 35 turns off the second switch SW2 and the fourth switch SW4 with the second control signal (CNTL2).

If determining in S7 and S7A that the ejection heater drive voltages (VH1 and VH2) are both lower than or equal to the threshold value (Vth) and determining in S8 that the carriage unit 11 has reached the return position, the CPU 35 stops driving the first and 13th nozzle arrays (S9 and S9A). In other words, the CPU 35 determines that the wirings for the first and 13th nozzle arrays have not been broken.

Thereafter, the CPU 35 drives the second nozzle array (the odd numbered array O in the nozzle array RA in the nozzle group PBk1) and the 14th nozzle array (the odd numbered array O in the nozzle array RA in the nozzle group Ye), which are next to the first and 13th nozzle arrays (S14 and S14A). The CPU 35 then determines whether any of the wirings for the second and 14th nozzle arrays has been broken. The processes in S14 to S19A are similar to the above-described processes in S4 to S9A except that the drive target nozzle arrays are changed, and description thereof is therefore omitted.

Thus, similar processes to the above-described processes in S4 to S9A are executed on the other nozzle arrays. For each pair of drive target nozzle arrays, the CPU 35 sequentially determines whether any of the wirings for the drive target nozzle arrays has been broken. The last drive target nozzle arrays are the 12th nozzle array (the odd numbered array O in the nozzle array RB in the nozzle group PBk2) and the 24th nozzle array (the odd numbered array O in the nozzle array RB in the nozzle group Cy). If determining that the wirings for the 12th and 24th nozzle arrays have not been broken, the CPU 35 stops driving these nozzle arrays (S20A and S20). The CPU 35 then turns off the second and fourth switches SW2 and SW4 with the second control signal (CNTL2) (S21) to terminate the breakage detection process.

In the present embodiment, two systems of supply sources are formed to supply ejection heater drive voltages to the print head. Alternatively, three or more systems of ejection heater drive voltage supply sources may be provided, or a plurality of systems may be provided individually for all ink colors. These cases can be implemented by using an ejection heater drive voltage supply source for each system, a switch provided to a power supply line between the supply source and the corresponding ejection heaters, and a voltage monitor that monitors the ejection heater drive voltage across each system. In this way, it is possible to simultaneously detect breakages of wirings for the plurality of systems of ejection heater drive voltage supply sources. Accordingly, it is possible to shorten the time necessary to detect breakage.

Meanwhile, as in the foregoing embodiments, the sequence for detecting breakage in the FFC may be executed simultaneously with various non-printing operations in which the carriage unit is moved for purposes other than printing. Also, the process of detecting breakage in the FFC may be executed in a state where the carriage unit is stopped.

As described above, in the present embodiment, it is possible to simultaneously detect breakages of wirings for a plurality of ejection heater drive voltage supply sources and accordingly shorten the time necessary to detect breakage.

Fourth Embodiment

The present embodiment suppresses deterioration in image quality of a printed image due to breakage of a wiring for a nozzle array in a configuration similar to the configuration in FIGS. 1A to 7 in the foregoing first embodiment.

Figure 13:
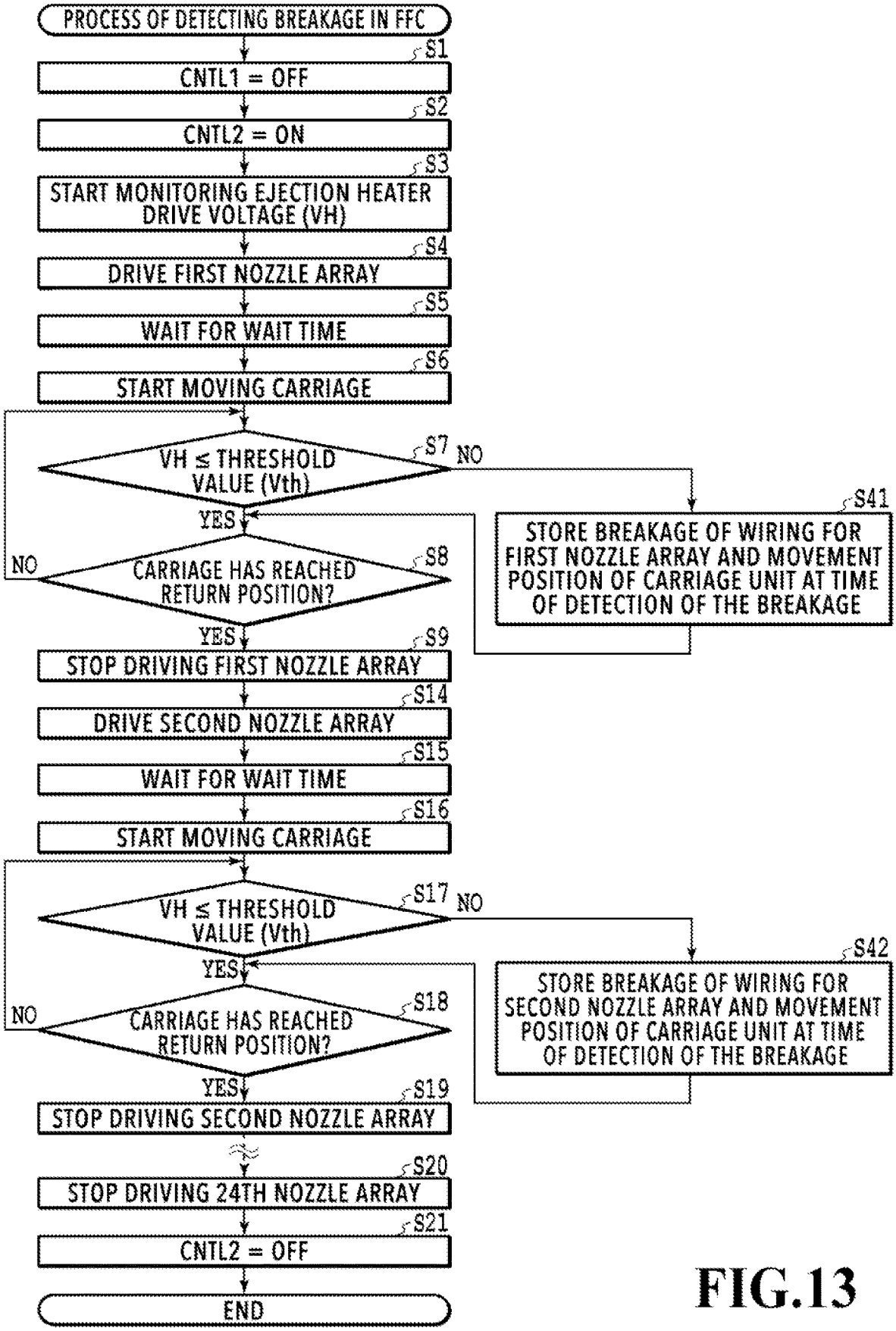
FIG. 13 is a flowchart for explaining a process of detecting breakage in an FFC in a fourth embodiment of the present invention.

FIG. 13 is a flowchart for explaining a process of detecting breakage in an FFC in the present embodiment, and differs from the flowchart in FIG. 6 in the foregoing first embodiment in that it includes S41 and S42 in place of S10 to S13 in the flowchart in FIG. 6. Similar steps to steps in FIG. 6 in the first embodiment are denoted by S with the identical numbers, and description thereof is omitted.

If the first voltage (V1), which is the ejection heater drive voltage (VH), is higher than the threshold value (Vth) in S7, that is, if breakage of a wiring for the first nozzle array (the even numbered array E in the nozzle array RA in the nozzle group PBk1) is detected, the CPU 35 proceeds to S41. In S41, the CPU 35 stores the fact that breakage of a wiring for the first nozzle array has been detected, and the movement position of the carriage unit 11 at the point of the detection of the breakage in the ROM 36 (see FIG. 2). The movement position of the carriage unit 11 is detected by the encoder sensor 15 (see FIG. 2). Then, the CPU 35 iterates the processes in S7 and S8 until the carriage unit 11 reaches the return position.

After finishing the breakage detection for the wirings for the first nozzle array, the CPU 35 stops driving that nozzle array (S9), and then performs the breakage detection for the wirings for the second nozzle array (the odd numbered array O in the nozzle array RA in the nozzle group PBk1) (S14 to S19 and S42). S14 to S19 and S42 are similar to S1 to S9 and S41, and description thereof is therefore omitted. Thus, the CPU 35 executes similar processes to the above-described processes in S1 to S9 and S41 on the other nozzle arrays. Then, if detecting breakage of a wiring for any of these nozzle arrays, the CPU 35 sequentially stores the nozzle array for which the breakage has been detected and the movement position of the carriage unit 11 at the point of the detection of the breakage. After finishing the breakage detection process for the wirings for all nozzle arrays, the CPU 35 turns off the second switch SW2 with the second control signal (CNTL2) (S21) to terminate the breakage detection process.

Figure 14A:
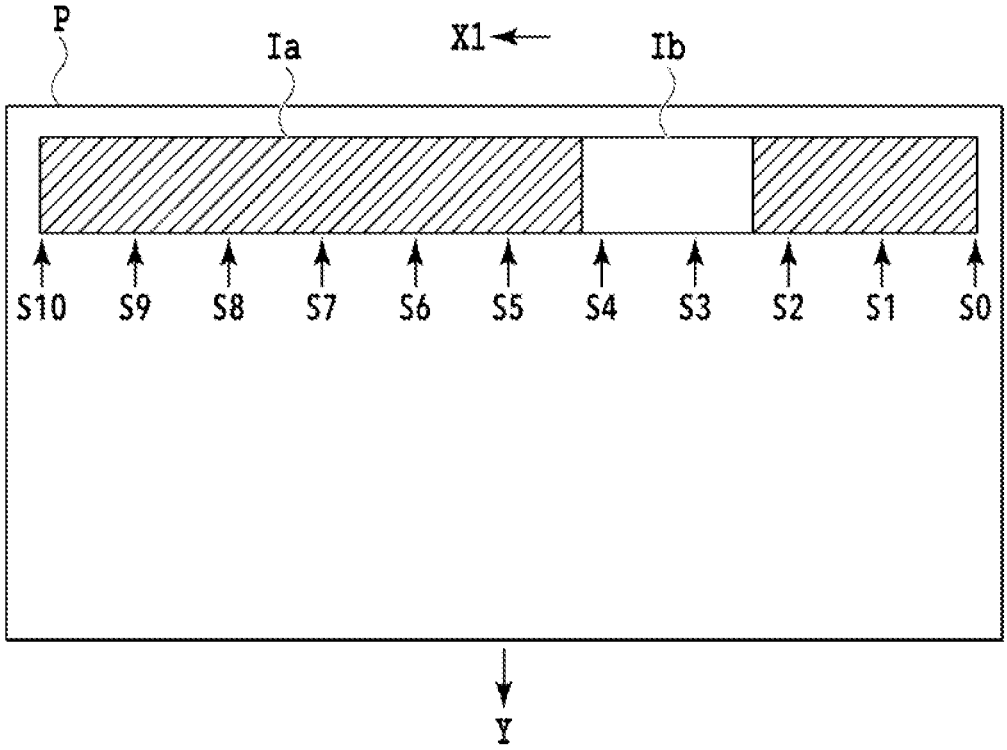
FIG. 14A is an explanatory diagram of an image printed in a single printing scanning of a print head.

FIG. 14A is an explanatory diagram of a printed image Ia printed on a print medium P by a single printing scanning of the print head 13 in the direction of arrow X1. Specifically, FIG. 14A is an explanatory diagram of a case where broken portions of a wiring in the FFC for the first nozzle array is connected or disconnected depending on the movement position of the carriage unit 11 while the first nozzle array is driven. The temporary disconnection of the wiring results in a local blank area Ib in the printed image Ia.

In the case of performing the process of detecting breakage in the FFC in the printing apparatus in such a state, the voltage monitor 46 (see FIGS. 5A and 5B) samples the ejection heater drive voltage (VH) at sampling timings S0 to S10. Then, in S7 in FIG. 13, the process of determining whether there is breakage is performed on the basis of the sampled ejection heater drive voltage (VH). No breakage is detected in the determination process from the timing S0 to the timing S2 but breakage is detected in the determination process at the timings S3 and S4. In this case, the fact that the first nozzle array is the nozzle array for which the wiring breakage was detected (e.g., the name of the nozzle array), and the movement positions of the carriage unit 11 corresponding to the timings S3 and S4 are stored in the ROM 36 (see FIG. 2). No breakage is detected in subsequent the determination process from the timing S5 to timing S10. A similar breakage detection process is performed for the other nozzle arrays.

Figure 14B:
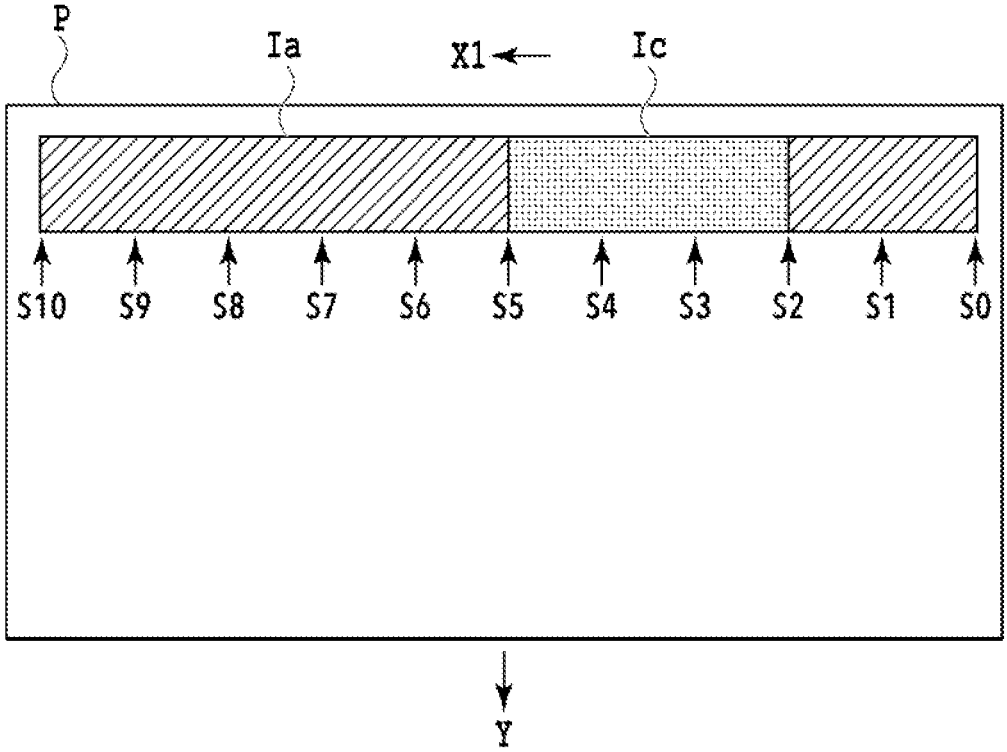
FIG. 14B is an explanatory diagram of a case where the blank area in the image in FIG. 14A is printed with a different nozzle array.

FIG. 14B is an explanatory diagram of a case where an image Ic to be printed on the blank area Ib in FIG. 14A is complemented by printing it with a different nozzle array. A normal printing operation is executed after performing the process of determining whether there is breakage on the basis of the ejection heater drive voltage (VH) sampled at the sampling timings S0 to S10 as illustrated in FIG. 14A. In this printing operation, the image Ic to be printed in the region from the timing S2 to the timing S5, including the timings S3 and S4 at which breakage was detected, is complemented by printing it with a different nozzle array.

In the case where breakage of a wiring for the first nozzle array (the even numbered array E in the nozzle array RA in the nozzle group PBk1) has been detected, as in the present example, the image to be printed can be complemented by using the third nozzle array (the even numbered array E in the nozzle array RB in the nozzle group PBk1). This is because the nozzles in the first and third nozzle arrays are at identical positions in the Y direction, as illustrated in FIG.

4B. The region from the timing S0 to the timing S2 and the region from the timing S5 to the timing S10 are printed with the first nozzle array, whereas the region from the timing S2 to the timing S5 is printed with the third nozzle array. In this way, it is possible to achieve print quality equivalent to that of an image printed with the first nozzle array. The same applies to cases where breakage of wirings for the other nozzle arrays are detected.

In the present example, two nozzle groups PBk1 and PBk2 are formed as the nozzle group PBk for the black ink. For this reason, in the case where breakage of a wiring for the first nozzle array is detected, it is possible to complement the image to be printed by using these nozzle groups PBk1 and PBk2. Specifically, it is possible to complement the image to be printed by using the ninth nozzle array (the even numbered array E in the nozzle array RA in the nozzle group PBk2) or the 11th nozzle array (the even numbered array E in the nozzle array RB in the nozzle group PBk2).

As described above, in the present embodiment, a non-printed area in an image due to breakage of a wiring for a nozzle array is complemented via printing with a different nozzle array. In this way, it is possible to suppress deterioration in image quality of a printed image due to breakage.

Other Embodiments

The serial data (SDATA) in the breakage detection operation only needs to be data on the ink ejection from at least one nozzle in the corresponding nozzle array. For example, it is possible to use print data dedicated for breakage detection, normal print data, test pattern print data, or the like.

The present invention can be implemented with a process involving: supplying a program that implements one or more of the functions in the above embodiments to a system or an apparatus through a network or a storage medium; and causing one or more processors in a computer in the system or the apparatus to read out and execute the program. Also, the present invention can be implemented with a circuit that implements one or more of the functions (e.g., ASIC).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-136687 filed Jul. 20, 2018, which is hereby incorporated by reference wherein in its entirety.

What is claimed is:

1. An inkjet printing apparatus comprising:

a print head comprising a plurality of nozzle arrays each being an array of a plurality of nozzles capable of ejecting ink;

a carriage on which the print head is mounted and which is capable of moving in a direction crossing the nozzle arrays;

a control unit configured to supply a first power as a drive power for the nozzles for ejecting the ink from the nozzles and a control signal for controlling drive of the nozzles to the print head through a cable, the control unit driving the nozzles with the first power on the basis of the control signal while moving the carriage during a printing operation; and a voltage detection unit configured to detect a change in voltage of a second power in a case where the second power is supplied to the print head through the cable as a drive power for the nozzles, the second power being a supply power lower than the first power, wherein the control unit executes a breakage detection operation involving driving the nozzles in the nozzle arrays on an array-by-array basis with the second power on the basis of the control signal, and detecting whether there is breakage in the cable on the basis of a result of the detection by the voltage detection unit during the driving of the nozzles, and the control unit executes the breakage detection operation in a state where the carriage is stopped.

2. The inkjet printing apparatus according to claim 1, wherein the second power drives the nozzles to such an extent that the ink is not ejected from the nozzles.

3. The inkjet printing apparatus according to claim 1, further comprising a second power supply unit configured to supply the second power, wherein the second power supply unit supplies a power with a constant voltage, as the second power, that exhibits a predetermined voltage drop or more when driving the nozzles, and the voltage detection unit detects whether or not the second power has exhibited the predetermined voltage drop or more.

4. The inkjet printing apparatus according to claim 1, wherein the control signal includes a plurality of control signals corresponding to the plurality of nozzle arrays, and the cable includes a power supply line through which to supply the drive powers for the nozzles and a plurality of signal lines through which to supply the plurality of control signals.

5. The inkjet printing apparatus according to claim 4, wherein the control unit identifies which line among the power supply line and the plurality of signal lines has been broken on the basis of the result of the detection by the voltage detection unit obtained while the nozzles in the nozzle arrays are driven on an array-by-array basis during the execution of the breakage detection operation.

6. The inkjet printing apparatus according to claim 1, wherein the control unit executes the breakage detection operation on the basis of an instruction from an operator.

7. The inkjet printing apparatus according to claim 1, wherein the control unit executes the breakage detection operation while the inkjet printing apparatus is started.

8. The inkjet printing apparatus according to claim 1, wherein the plurality of nozzle arrays are grouped into a plurality of groups, the second power and the control signal are supplied to each of the plurality of groups, and the control unit executes the breakage detection operation for each of the plurality of groups simultaneously.

9. The inkjet printing apparatus according to claim 1, further comprising a reporting unit configured to report a result of the detection by the control unit obtained by executing the breakage detection operation.

10. The inkjet printing apparatus according to claim 1, wherein the control unit drives, on the basis of a result of the detection obtained by executing the breakage detection operation, nozzles other than nozzles affected by breakage in the cable instead of driving the affected nozzle, during the printing operation.

11. The inkjet printing apparatus according to claim 1, wherein the nozzles each include an ejection port and an ejection energy generation element configured to generate ejection energy for ejecting the ink from the ejection port, and the ejection energy generation element is driven by the first power and the second power on the basis of the control signal.

12. An inkjet printing apparatus comprising:

a print head comprising a plurality of nozzle arrays each being an array of a plurality of nozzles capable of ejecting an ink;

a carriage on which the print head is mounted and which is capable of moving in a direction crossing the nozzle arrays;

a control unit configured to supply a first power as a drive power for the nozzles for ejecting ink from the nozzles and a control signal for controlling drive of the nozzles to the print head through a cable, the control unit driving the nozzles with the first power on the basis of the control signal while moving the carriage during a printing operation; and a voltage detection unit configured to detect a change in voltage of a second power in a case where the second power is supplied to the print head through the cable as a drive power for the nozzles, the second power being a supply power lower than the first power, wherein the control unit executes a breakage detection operation involving driving the nozzles in the nozzle arrays on an array-by-array basis with the second power on the basis of the control signal, and detecting whether there is breakage in the cable on the basis of a result of the detection by the voltage detection unit during the driving of the nozzles, and the control unit executes the breakage detection operation while moving the carriage.

13. The inkjet printing apparatus according to claim 12, wherein the second power drives the nozzles to such an extent that the ink is not ejected from the nozzles.

14. The inkjet printing apparatus according to claim 12, further comprising a second power supply unit configured to supply the second power, wherein the second power supply unit supplies a power with a constant voltage, as the second power, that exhibits a predetermined voltage drop or more when driving the nozzles, and the voltage detection unit detects whether or not the second power has exhibited the predetermined voltage drop or more.

15. The inkjet printing apparatus according to claim 12, wherein the control signal includes a plurality of control signals corresponding to the plurality of nozzle arrays, and the cable includes a power supply line through which to supply the drive powers for the nozzles and a plurality of signal lines through which to supply the plurality of control signals.

16. The inkjet printing apparatus according to claim 15, wherein the control unit identifies which line among the power supply line and the plurality of signal lines has been broken on the basis of the result of the detection by the voltage detection unit obtained while the nozzles in the nozzle arrays are driven on an array-by-array basis during the execution of the breakage detection operation.

17. The inkjet printing apparatus according to claim 12, further comprising:

a sensor mounted to the carriage and configured to detect a print medium; and a detection unit configured to detect a width of the print medium on the basis of a relation between a movement position of the carriage and a result of the detection by the sensor, wherein the control unit executes the breakage detection operation during movement of the carriage for the detection of the width of the print medium by the detection unit.

18. The inkjet printing apparatus according to claim 12, wherein the control unit executes the breakage detection operation on the basis of an instruction from an operator.

19. The inkjet printing apparatus according to claim 12, wherein the control unit executes the breakage detection operation while the inkjet printing apparatus is started.

20. The inkjet printing apparatus according to claim 12, wherein the plurality of nozzle arrays are grouped into a plurality of groups, the second power and the control signal are supplied to each of the plurality of groups, and the control unit executes the breakage detection operation for each of the plurality of groups simultaneously.

21. The inkjet printing apparatus according to claim 12, further comprising a reporting unit configured to report a result of the detection by the control unit obtained by executing the breakage detection operation.

22. The inkjet printing apparatus according to claim 12, wherein the control unit drives, on the basis of a result of the detection obtained by executing the breakage detection operation, nozzles other than nozzles affected by breakage in the cable instead of driving the affected nozzle during the printing operation.

23. The inkjet printing apparatus according to claim 12, wherein the nozzles each include an ejection port and an ejection energy generation element configured to generate ejection energy for ejecting the ink from the ejection port, and the ejection energy generation element is driven by the first power and the second power on the basis of the control signal.

* * * * *